US009277832B2

(12) United States Patent
Theisen et al.

(10) Patent No.: US 9,277,832 B2
(45) Date of Patent: Mar. 8, 2016

(54) TESTER DISPLAY FIXTURE

(71) Applicant: Target Brands, Inc., Minneapolis, MN (US)

(72) Inventors: Jennifer A. Theisen, Crystal, MN (US); Nick Q. Trinh, Minneapolis, MN (US); Benjamin Weshler, New York, NY (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/657,199

(22) Filed: Mar. 13, 2015

(65) Prior Publication Data

US 2015/0182039 A1 Jul. 2, 2015

Related U.S. Application Data

(62) Division of application No. 14/280,878, filed on May 19, 2014, now Pat. No. 9,060,625, which is a division of application No. 13/402,223, filed on Feb. 22, 2012, now Pat. No. 8,763,819.

(51) Int. Cl.

| | |
|---|---|
| ***A47G 29/00*** | (2006.01) |
| ***A47F 7/00*** | (2006.01) |
| ***G09F 13/04*** | (2006.01) |

(Continued)

(52) U.S. Cl.

CPC ..... *A47F 7/0028* (2013.01); *A47F 5/0025* (2013.01); *A47F 5/0062* (2013.01); *A47F 7/286* (2013.01); *G09F 3/204* (2013.01); *G09F 13/04* (2013.01); *G09F 23/06* (2013.01); *A45D 40/0087* (2013.01); *A47B 81/00* (2013.01); *A47F 3/14* (2013.01)

(58) Field of Classification Search

CPC ..... A47F 7/0028; A47F 5/0025; A47F 7/286; A47F 5/0062; A47F 3/14; G09F 13/04; G09F 23/06; G09F 3/204; A45D 40/0087

USPC ..... 211/119.003, 59.3, 59.2, 4, 183, 184, 211/90.01, 90.02, 134, 71.01; 206/562, 206/560, 564; 220/507, 523; 108/25, 26, 108/106–110, 147.11; 312/117, 118, 126, 312/128, 291, 348.3; 248/136, 137, 235, 248/134, 135

See application file for complete search history.

(56) References Cited

U.S. PATENT DOCUMENTS

| | | | |
|---|---|---|---|
| 1,990,398 | A | 2/1935 | Beddingfield |
| 2,421,646 | A | 6/1947 | Pepin |

(Continued)

FOREIGN PATENT DOCUMENTS

| | | |
|---|---|---|
| EP | 0026693 | 4/1981 |
| FR | 2706269 | 12/1994 |

*Primary Examiner* — Joshua J Michener
*Assistant Examiner* — Devin Barnett
(74) *Attorney, Agent, or Firm* — Leanne Taveggia Farrell; Westman, Champlin & Koehler, P.A.

(57) ABSTRACT

A display fixture includes a shelf having a tester product receptacle, at least one first tester product assembly and an elongated channel. The at least one first tester product assembly has a base and a cover. The cover includes a hinge component. The base is located in the tester product receptacle of the shelf. The elongated channel is coupled to the shelf and is configured to receive and retain the hinge component of the cover such that the cover is rotatable about a back edge of the base of the at least one first tester product assembly.

18 Claims, 24 Drawing Sheets

(51) Int. Cl.

| | |
|---|---|
| ***G09F 23/06*** | (2006.01) |
| ***G09F 3/20*** | (2006.01) |
| ***A47F 5/00*** | (2006.01) |
| ***A47F 7/28*** | (2006.01) |
| *A47B 81/00* | (2006.01) |
| *A47F 3/14* | (2006.01) |
| *A45D 40/00* | (2006.01) |

(56) References Cited

U.S. PATENT DOCUMENTS

| | | | |
|---|---|---|---|
| 2,883,048 | A | 4/1959 | Lentz |
| 2,885,091 | A | 5/1959 | Van Pelt |
| 3,285,429 | A | 11/1966 | Propst |
| D210,055 | S | 1/1968 | Walker |
| 3,539,237 | A | 11/1970 | Acker |
| D250,441 | S | 12/1978 | Richman et al. |
| 4,406,368 | A | 9/1983 | Hermes |
| 4,476,985 | A | 10/1984 | Norberg et al. |
| 4,479,583 | A | 10/1984 | Franklin et al. |
| 4,611,720 | A | 9/1986 | Staab |
| D290,534 | S | 6/1987 | Wendkos |
| 4,759,449 | A | 7/1988 | Gold |
| 4,775,058 | A | 10/1988 | Yatsko |
| 4,858,774 | A | 8/1989 | Winter et al. |
| 4,991,712 | A | 2/1991 | Wagner |
| 5,255,802 | A | 10/1993 | Krinke et al. |
| 5,312,000 | A | 5/1994 | Bass |
| 5,474,190 | A | 12/1995 | Won-Kim |
| 5,642,807 | A | 7/1997 | Barnes |
| 5,673,801 | A | 10/1997 | Markson |
| 5,685,436 | A | 11/1997 | Davet |
| 5,706,977 | A | 1/1998 | Ogura et al. |
| 5,765,690 | A | 6/1998 | Baxter |
| 6,006,678 | A | 12/1999 | Merit et al. |
| 6,047,647 | A | 4/2000 | Laraia, Jr. |
| D434,875 | S | 12/2000 | Gavin |
| 6,164,215 | A | 12/2000 | Cook et al. |
| 6,299,002 | B1 | 10/2001 | Garnier |
| 6,336,564 | B1 | 1/2002 | Garnier |
| 6,527,129 | B2 | 3/2003 | Osawa |
| 7,028,851 | B1 | 4/2006 | Fenger |
| 7,395,938 | B2 | 7/2008 | Merit et al. |
| D585,494 | S | 1/2009 | Yoshikawa |
| 7,604,132 | B2 | 10/2009 | Richardson et al. |
| D609,510 | S | 2/2010 | Stafford et al. |
| 7,905,362 | B2 | 3/2011 | Slimane |
| 7,934,609 | B2 | 5/2011 | Alves et al. |
| 7,950,538 | B2 | 5/2011 | Zang et al. |
| 8,016,139 | B2 | 9/2011 | Hanners et al. |
| 8,087,522 | B2 | 1/2012 | Stafford et al. |
| 8,104,630 | B2 | 1/2012 | Schneider |
| 8,123,185 | B2 | 2/2012 | Winig et al. |
| 8,186,522 | B2 | 5/2012 | Weshler et al. |
| 8,256,628 | B2 | 9/2012 | Stafford et al. |
| 8,517,191 | B2 | 8/2013 | Paeth |
| 8,579,125 | B2 | 11/2013 | Trinh et al. |
| 2002/0027115 | A1 | 3/2002 | Gay et al. |
| 2003/0034319 | A1 | 2/2003 | Meherin et al. |
| 2003/0168458 | A1 | 9/2003 | Lafferty et al. |
| 2004/0075374 | A1 | 4/2004 | Von Der Burg et al. |
| 2005/0045641 | A1 | 3/2005 | Doran |
| 2005/0139560 | A1 | 6/2005 | Whiteside et al. |
| 2005/0279753 | A1 | 12/2005 | Timm et al. |
| 2006/0237384 | A1 | 10/2006 | Neumann et al. |
| 2006/0260518 | A1 | 11/2006 | Josefsson et al. |
| 2007/0175844 | A1 | 8/2007 | Schneider |
| 2007/0251901 | A1 | 11/2007 | Werner |
| 2008/0121563 | A1 | 5/2008 | Polvere et al. |
| 2008/0138477 | A1 | 6/2008 | Mular et al. |
| 2009/0084742 | A1 | 4/2009 | Winkler et al. |
| 2009/0294390 | A1 | 12/2009 | Weshler |
| 2009/0294392 | A1 | 12/2009 | Stafford et al. |
| 2010/0181449 | A1 | 7/2010 | Weigand et al. |
| 2010/0252519 | A1 | 10/2010 | Hanners et al. |
| 2010/0326939 | A1 | 12/2010 | Clark et al. |
| 2011/0272374 | A1 | 11/2011 | Berry et al. |
| 2011/0309044 | A1 | 12/2011 | Morrow |
| 2012/0037578 | A1 | 2/2012 | Weshler et al. |
| 2012/0084961 | A1 | 4/2012 | Stafford et al. |

TESTER DISPLAY FIXTURE

CROSS-REFERENCE TO RELATED APPLICATIONS

The present application is a divisional of and claims priority to U.S. patent application Ser. No. 14/280,878, filed May 19, 2014, which is a divisional of, based on and claims the benefit of U.S. patent application Ser. No. 13/402,223, filed Feb. 22, 2012, the contents of which are hereby incorporated by reference in their entirety.

BACKGROUND

Retail stores use a variety of display fixtures to present products to customers for purchase. These display fixtures can support the product, indicate the product price, include signage for highlighting the product and/or include structures that hold samples of the product for testing. Exemplary display structures include shelves, trays, racks, peg hooks and other similar structures.

The discussion above is merely provided for general background information and is not intended to be used as an aid in determining the scope of the claimed subject matter.

SUMMARY

A display fixture includes a base unit having a tray receptacle, at least one tester tray assembly and an elongated channel. The at least one tester tray assembly has a base and a tray. The cover includes a hinge component. The tray is located in the tray receptacle of the base unit. The elongated channel is coupled to the shelf and is configured to receive and retain the hinge component of the cover such that the cover is rotatable about a back edge of the base of the at least one tester tray assembly.

The at least one tester tray assembly includes at least one product receptacle having a recessed surface that is recessed from the top surface of the tray for accommodating at least one tester product. The cover of the at least one tester tray assembly is rotatable about a back edge of the tray and having an opaque area and at least one transparent window surrounded by the opaque area. The at least one transparent window has a size and shape that is substantially the same as a size and a shape of the at least one product receptacle.

The display fixture optionally includes a test product divider assembly. The elongated channel is further configured to receive and retain at least one component of the test product divider assembly.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a display fixture for supporting test products, such as cosmetics, in a retail store. The display fixture displays the test products in an attractive manner that is easy and convenient for customers to access. The display fixture includes a base unit that supports tester products in both a first display configuration and in a second display configuration. In the first display configuration, tester products are provided in tester tray assemblies. In the second display configuration, tester products are provided in a test product divider assembly. The tester tray assemblies and the test product divider assembly are seamlessly coupled to the base unit of the display fixture by an elongated channel.

Figure 1A:
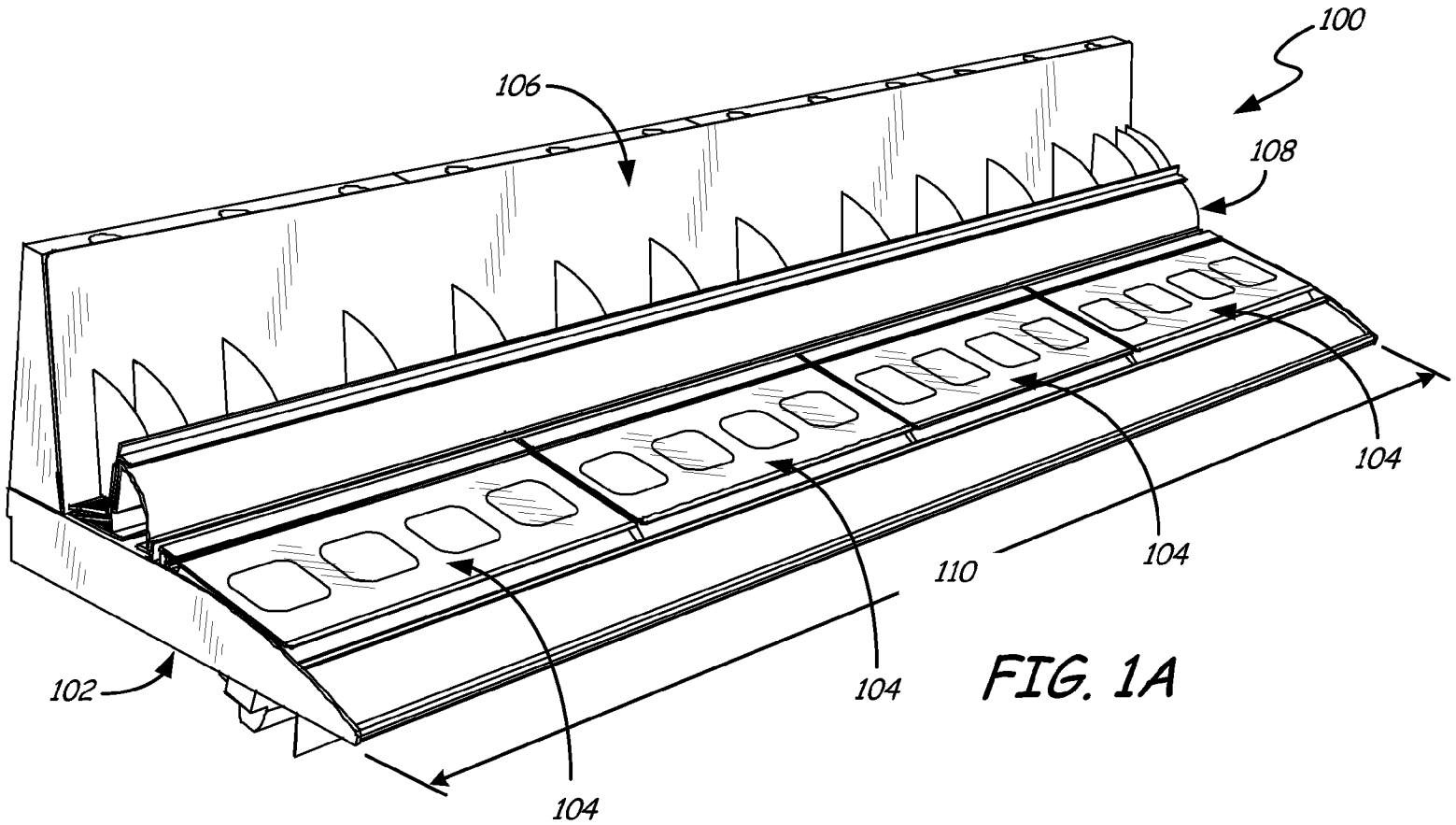
FIG. 1A illustrates a perspective view of a tester display fixture under one embodiment.
Figure 1B:
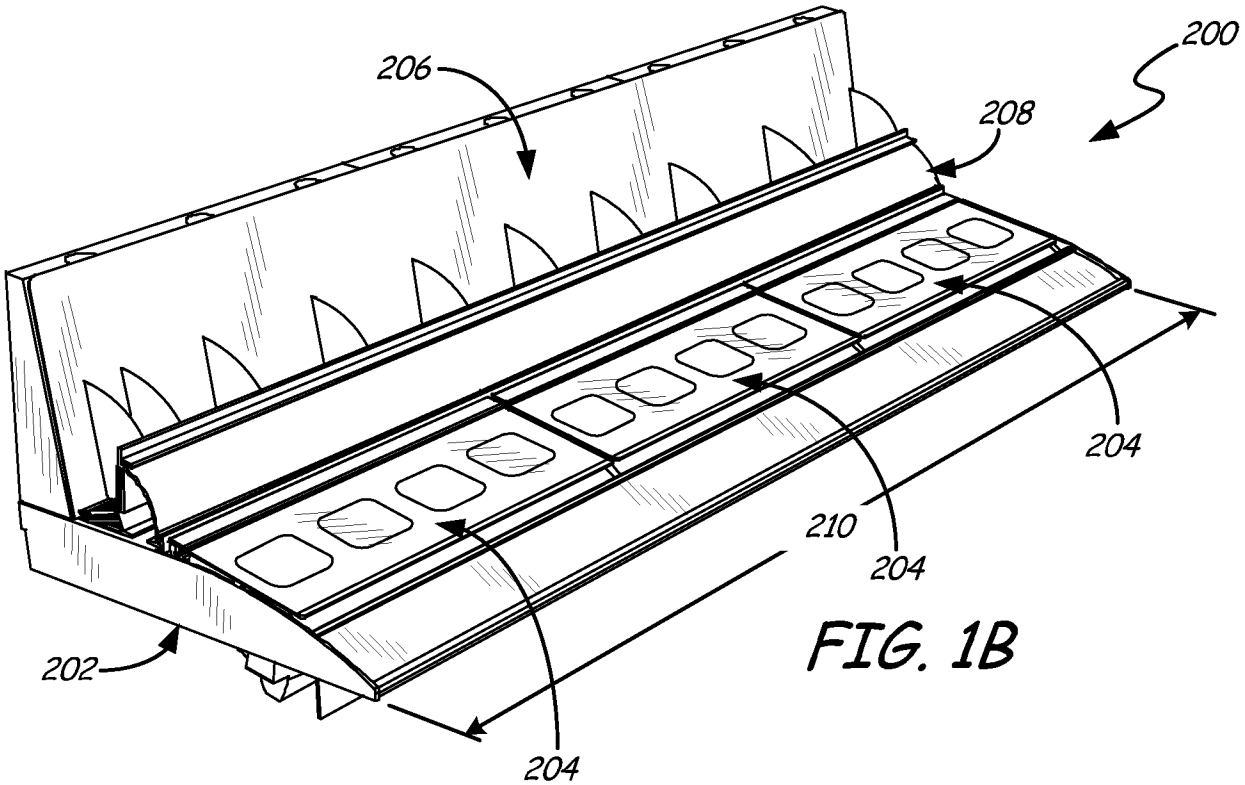
FIG. 1B illustrates a perspective view of a tester display fixture under another embodiment.

FIG. 1A illustrates a perspective view of a display fixture 100 according to one embodiment, while FIG. 1B illustrates a perspective view of a display fixture 200 according to another embodiment. Both display fixture 100 and display fixture 200 include base units 102 and 202 that support at least one tester tray assembly or tester product assembly 104 and 204 (or product tray assemblies) and a test product divider assembly 106 and 206. Both tester tray assemblies 104 and 204 and the test product divider assembly 106 and 206 are coupled to base units 102 and 202, respectively, by an elongated channel 108 and 208.

The main difference between display fixture 100 and display fixture 200 is their size. Base unit 102 includes a width 110 and base unit 202 includes a width 210. Width 110 is greater than width 210. Therefore the width 110 of base unit 102 is capable of accommodating four tester tray assemblies as illustrated in FIG. 1A, while the smaller width 210 of base unit 202 is capable of accommodating three tester tray assemblies as illustrated in FIG. 1B.

Figure 2:
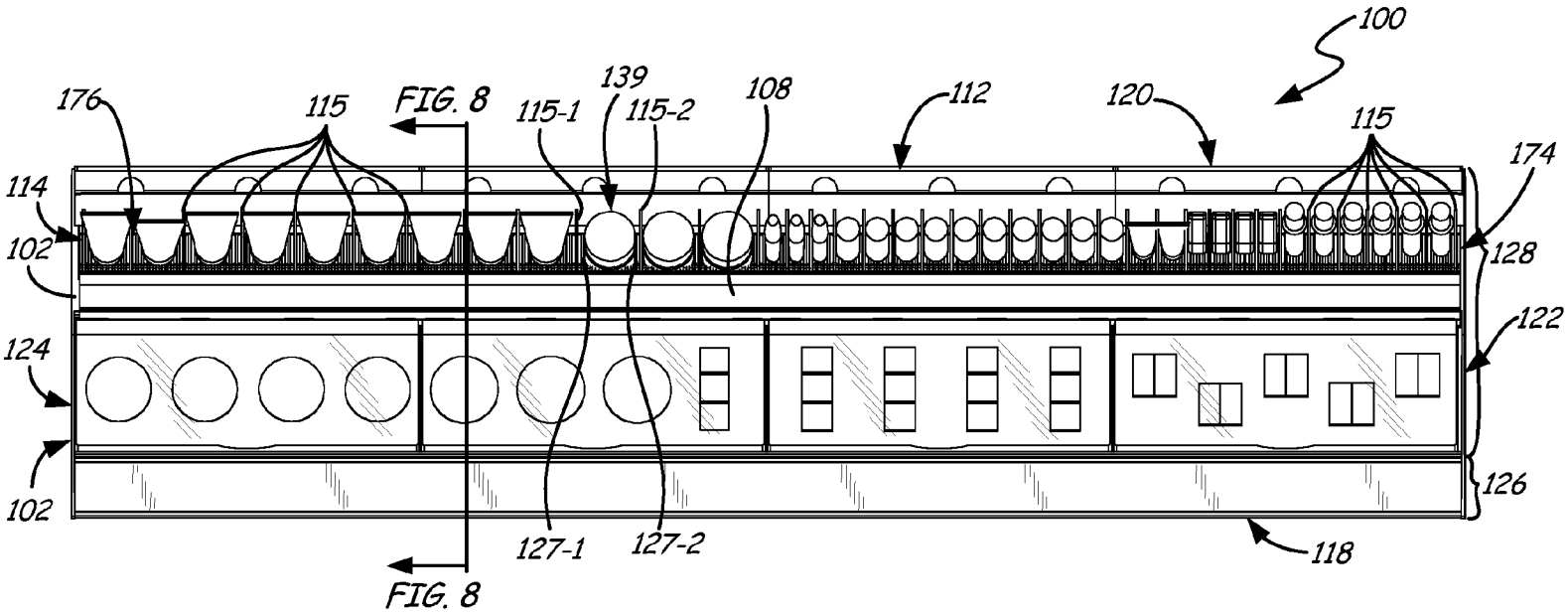
FIG. 2 illustrates a top view of the tester display fixture illustrated in FIG. 1A.
Figure 8:
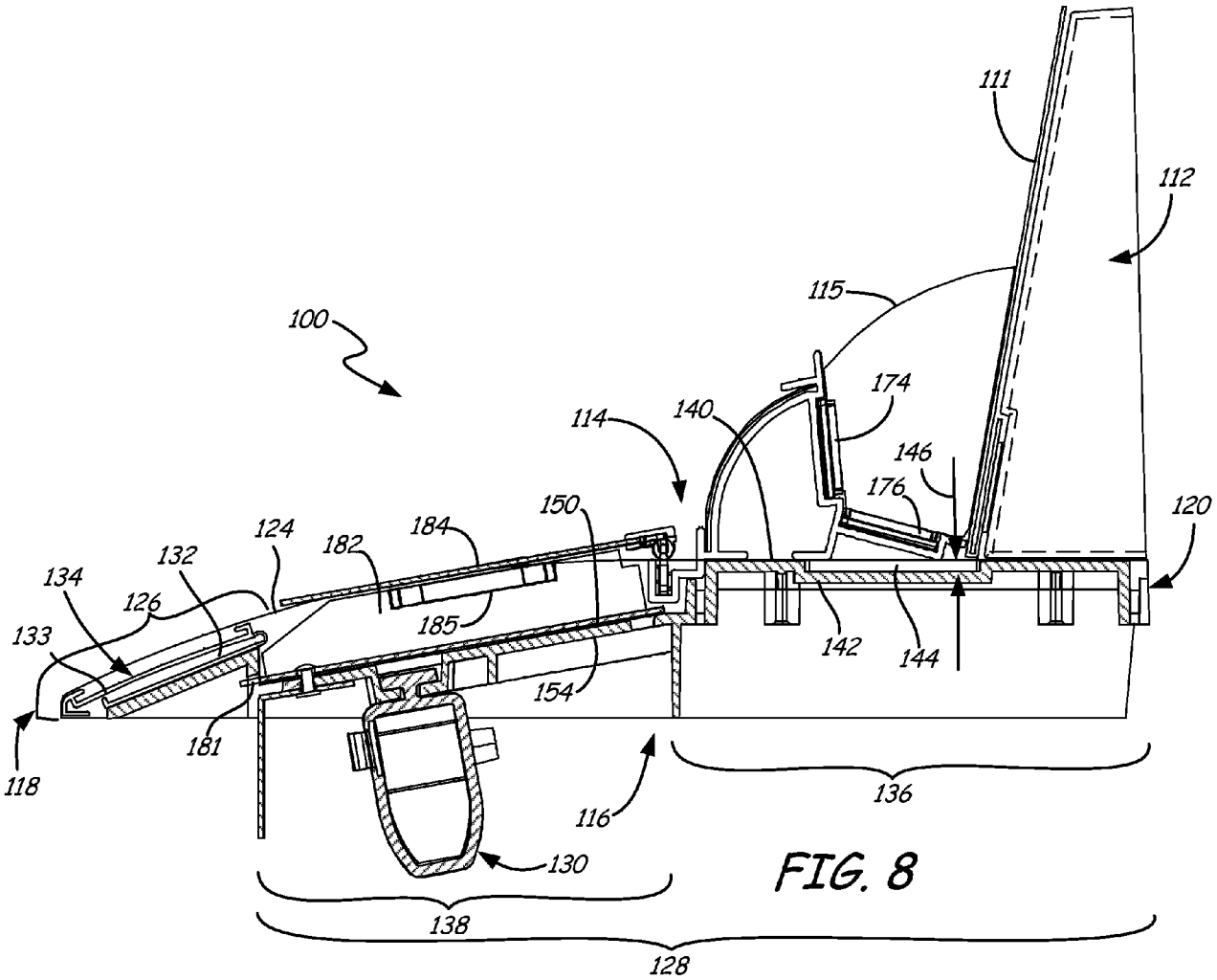
FIG. 8 illustrates a sectional view of the tester display fixture illustrated in FIG. 1A.
Figure 9:
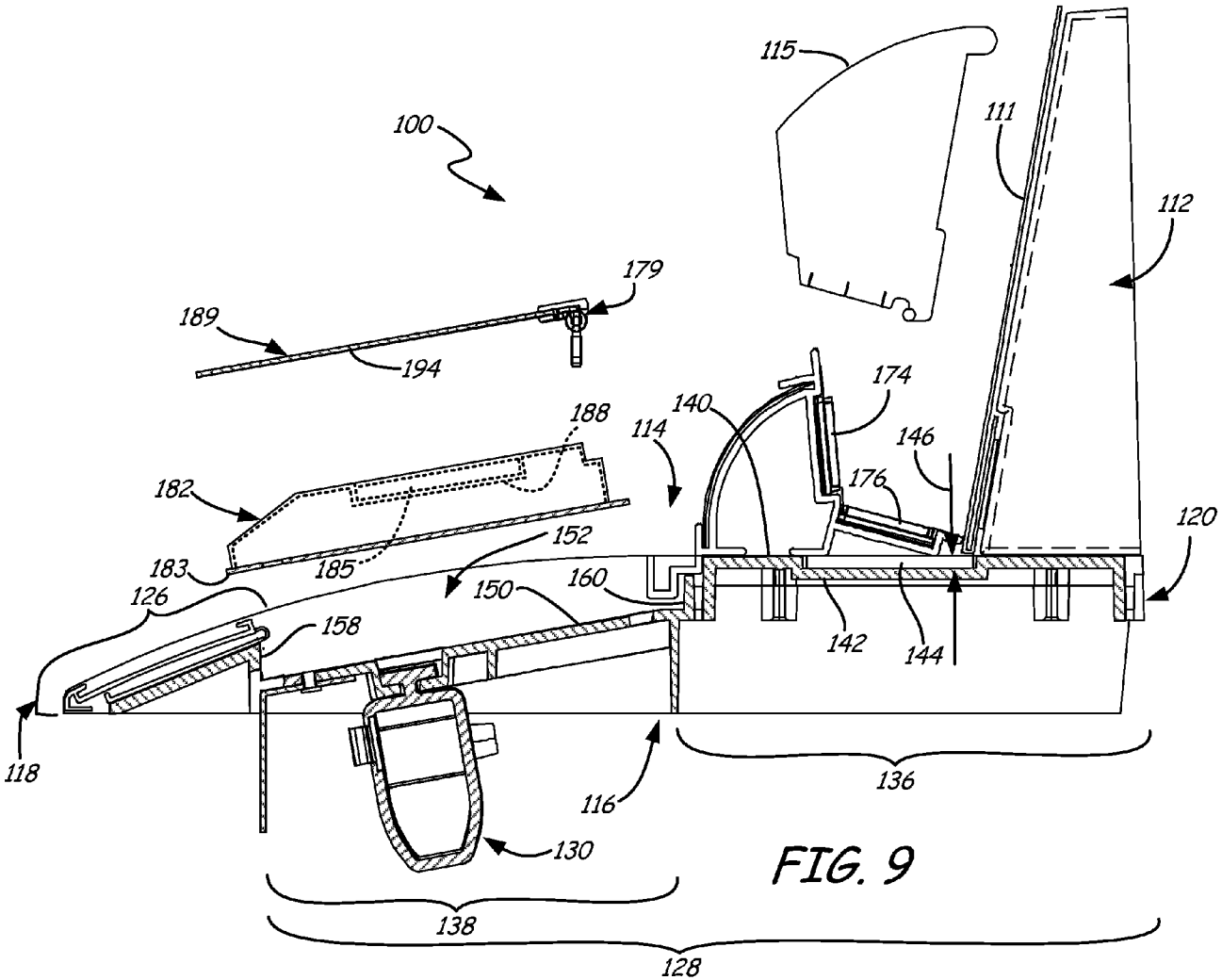
FIG. 9 illustrates an exploded sectional view of the tester display fixture illustrated in FIG. 1A.

FIGS. 2-7 illustrate orthogonal views of display fixture 100 including a top view, a bottom view, a right side view, a left side view, a front view and a back view. While the perspective view, the top view, the right side view, the left side view and the front view of display fixture 100 illustrate tester tray assemblies housing tester product, only the top and the front views of display fixture 100 illustrate tester products retained in tester product divider assembly. In addition, FIG. 8 illustrates a sectional view of display fixture 100 taken along the line illustrated in the top view of FIG. 2, and FIG. 9 illustrates display fixture 100 illustrated in FIG. 8 in an exploded configuration.

Base unit or support unit 102 is a shelf. Base unit 112 has a top 114 (FIGS. 2, 8 and 9), a bottom 116 (FIGS. 3, 8 and 9), a front 118 (FIGS. 6 and 8) or front edge, and a back 120 (FIGS. 4, 5, 7 and 8). Base unit 102 includes a first side 122 (FIG. 4), a second side 124 (FIG. 5), a display portion 126 (FIGS. 8 and 9) and a support portion 128 (FIG. 8). Base unit 102 also includes a lighting assembly 130 (FIGS. 3, 8 and 9) on the bottom 116. Base unit 102 is optionally formed of any of a variety of materials, including molded or machined polymeric materials, such as polypropylenes and styrene and are optionally formed, machined or casted from metallic materials such as sheet metals, steels and aluminum alloys.

Each of the first and second sides 122 and 124 is a substantially flat, thin, and wedge-shaped piece secured at one side of base unit 102. The first and second sides 122 and 124 are optionally formed continuously with display portion 126 (e.g., via injection molding) and support portion 128 as a single piece or as a separate piece (e.g., connected via adhesives or welding) with display portion 126 and support portion 128.

Display portion 126 is located toward the front 118 of base unit 102 and extends between first side 122 and second side 124 along width 110. Display portion 126 forms a substantially flat viewing area or surface 132 (FIG. 8). Display portion 126, and in particular, the substantially flat viewing area 132 of display portion 126, is angled downwardly in the forward direction and relative to support portion 128. In some embodiments, this facilitates viewing of indicia placed on the viewing surface 132 from different relative heights or positions. In some embodiments, an information sheet (not shown) including product information or other indicia is secured on the substantially flat viewing surface 132 using a strip carrier 133 (FIG. 8). Strip carrier 133 defines a mouth 134 (FIG. 8) for receiving a strip of material (not shown) or other carrier having indicia. In some embodiments, the strip carrier 133 is adhered to the flat viewing surface 132 using double sided adhesive, for example.

Figure 3:
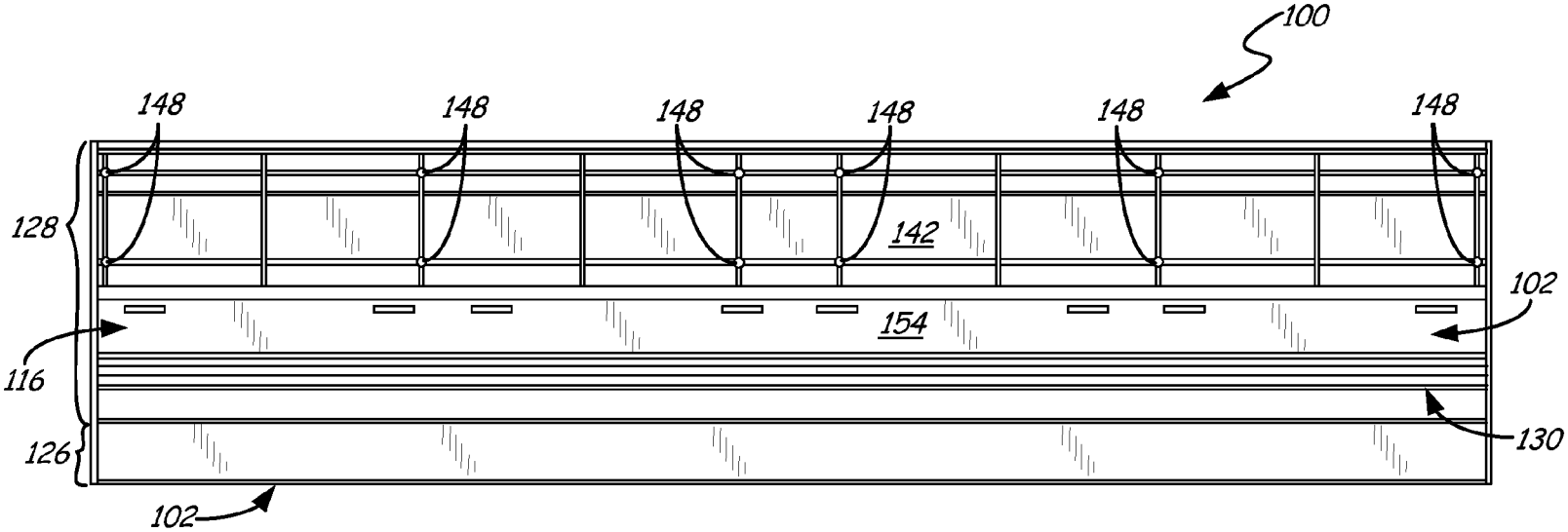
FIG. 3 illustrates a bottom view of the tester display fixture illustrated in FIG. 1A.
Figure 4:
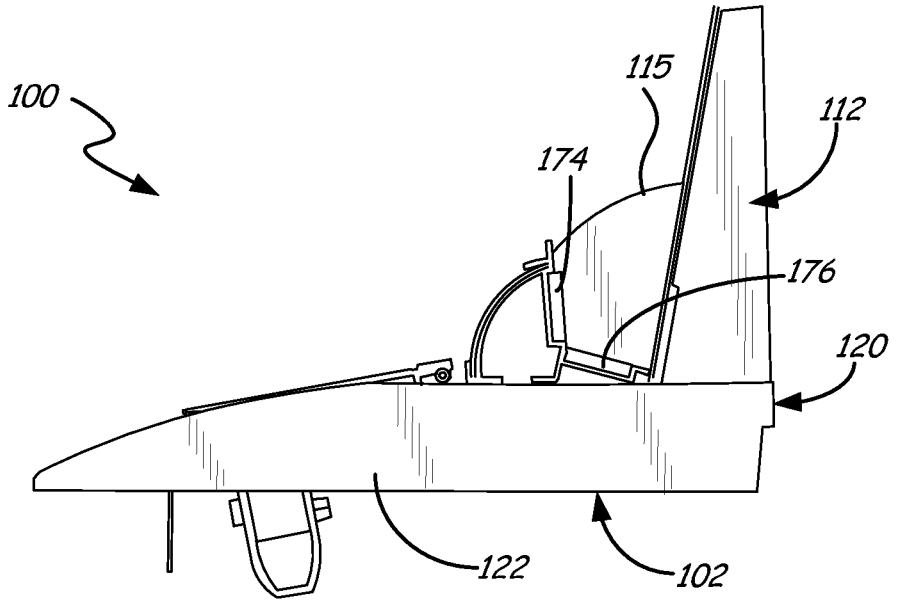
FIG. 4 illustrates a right side view of the tester display fixture illustrated in FIG. 1A.
Figure 5:
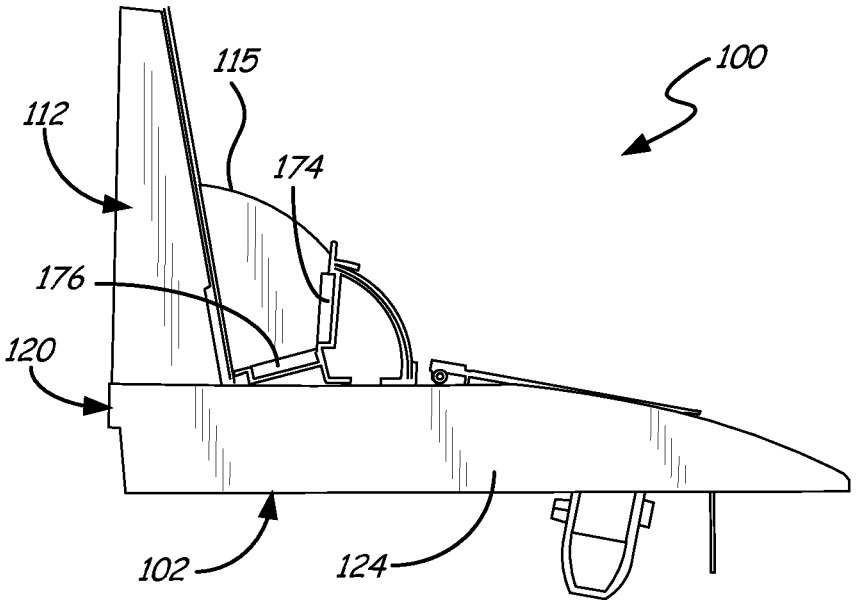
FIG. 5 illustrates a left side view of the of the tester display fixture illustrated in FIG. 1A.
Figure 6:
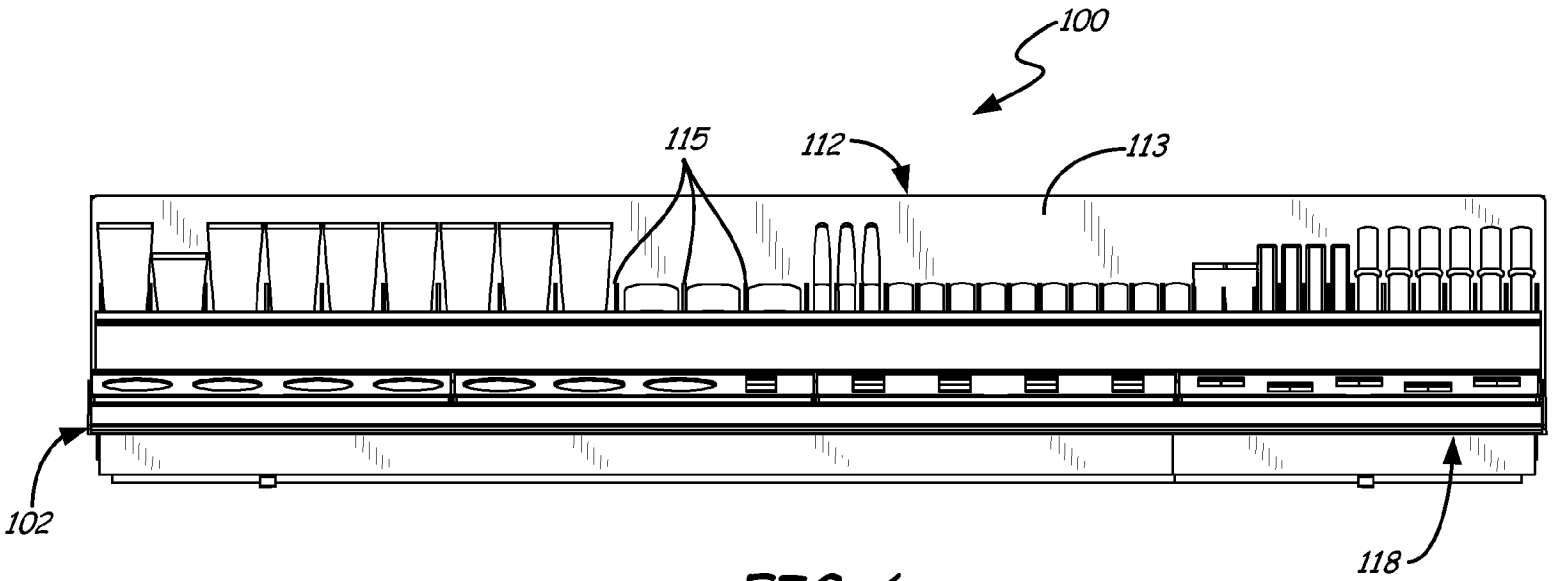
FIG. 6 illustrates a front view of the tester display fixture illustrated in FIG. 1A.
Figure 7:
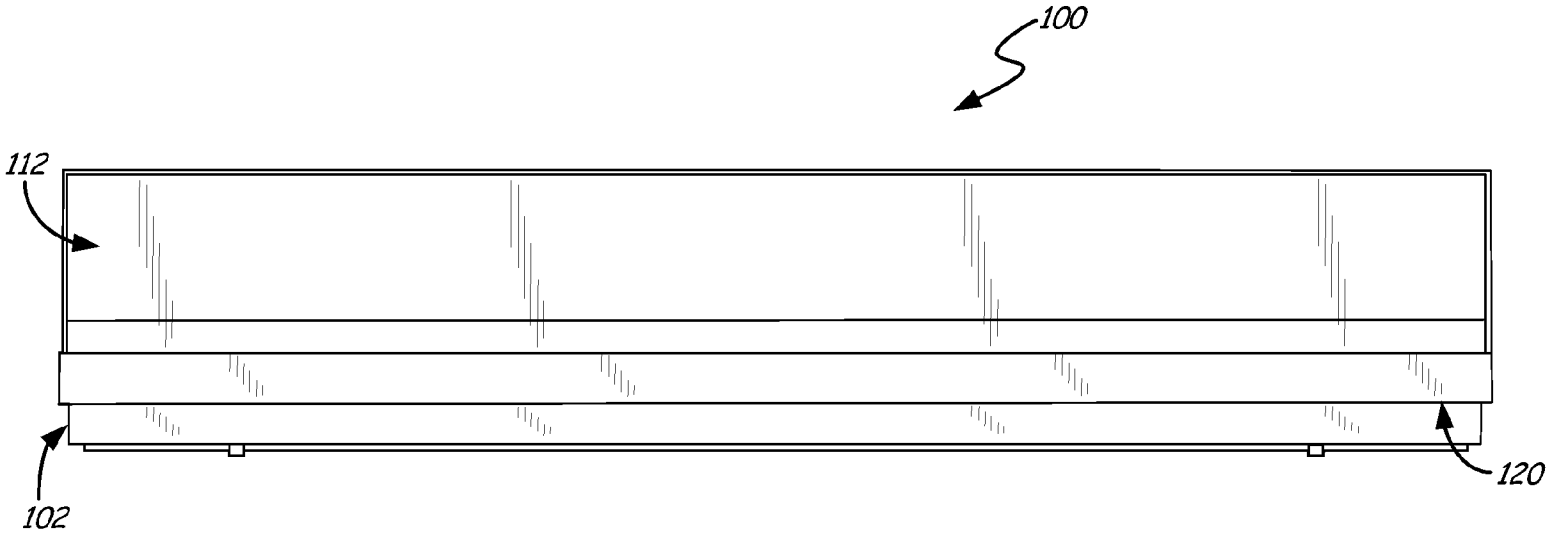
FIG. 7 illustrates a back view of the tester display fixture illustrated in FIG. 1A.

Support portion 128 of base unit 102 is optionally adapted for a tiered display configuration, with test products being supported at different heights. In particular, support portion 128 includes a rear support tier 136 (FIGS. 8 and 9) and a front support tier 138 (FIGS. 8 and 9), also described as rear and front product tiers. Rear support tier 136 is located toward the back 120 of base unit 112 and is optionally disposed at a substantially higher vertical position than front support tier 138. The rear support tier 136 optionally extends between first and second sides 122 and 124, along width 110, and has a top support surface 140 (FIG. 8) that is substantially flat and horizontal and a bottom assembly surface 142 (FIGS. 3, 8 and 9). The rear support tier 136 is configured to support the second display configuration of tester products (i.e., the test product divider assembly 106).

Figure 11:
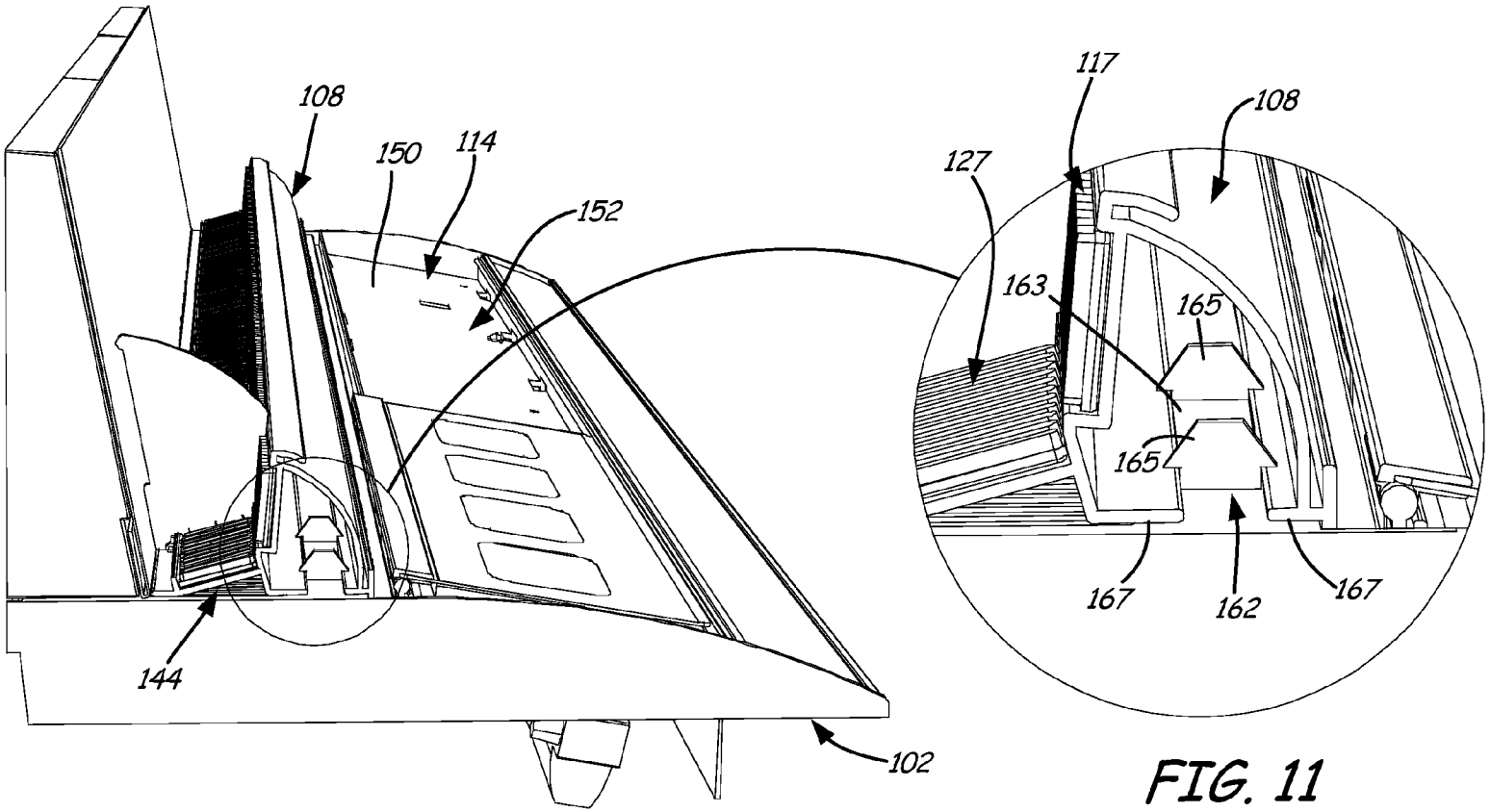
FIG. 11 illustrates an enlarged perspective view of a clip that secures the channel to the base of the tester display fixture illustrated in FIG. 1A.

Rear support tier 136 also includes a plurality of fixturing slots 144 (one exemplary slot is illustrated in FIGS. 8 and 9 and a plurality of fixturing slots are illustrated in FIG. 11) located across top support surface 140 between first and second sides 122 and 124 and along width 110. Each fixturing slot 144 extends from front to back for a slot depth 146 (FIGS. 8 and 9). The bottom assembly surface 142 forms a plurality of fastener posts 148 (FIG. 3) and is adapted to be secured to a bracket assembly (not shown) for coupling to a shelving unit (also not shown). For example, the shelving unit can be a shelf fixture having vertically oriented first and second standards or rails having a plurality of substantially vertically aligned columns of openings, also described as holes or slots, that are regularly spaced and are generally suitable for securing shelving to the shelf fixture via brackets coupled to the bracket assembly.

The front support tier 138 is located between rear support tier 136 and display portion 126 and extends between first side 122 and second side 124 along width 110. Front support tier 138 has an upper surface 150 (FIGS. 9 and 10) that forms a tray receptacle or tester product assembly receptacle 152 (FIGS. 9 and 11) and also has a bottom surface 154 (FIGS. 3 and 9) that includes a plurality of retaining structures (not shown), which facilitate the retaining of lighting assembly 130. The retaining structures each project downwardly and have optionally slotted bottoms, which retain lighting assembly 130. Front support tier 138 is angled downwardly in a forward direction relative to top support surface 140 of rear support tier 136. In some embodiments, the top support surface 140 of rear support tier 136 and upper surface 150 of front support tier 138 define an angle of about five degrees to about ten degrees. It should be realized, however, the angle can be a variety of angular offsets. The front support tier 136 is configured to support the first display configuration of tester products (i.e., the plurality of tester tray assemblies 104).

Tray receptacle 152 is optionally substantially rectangular, but can be a variety of other shapes. Tray receptacle 152 is formed by a front wall 158 (FIG. 9), a rear wall 160 (FIG. 9) and upper surface 150 and is configured to receive the plurality of tester tray assembles 104. Tray receptacle 152 is substantially recessed relative to display portion 126 and rear support tier 136.

Figure 10A:
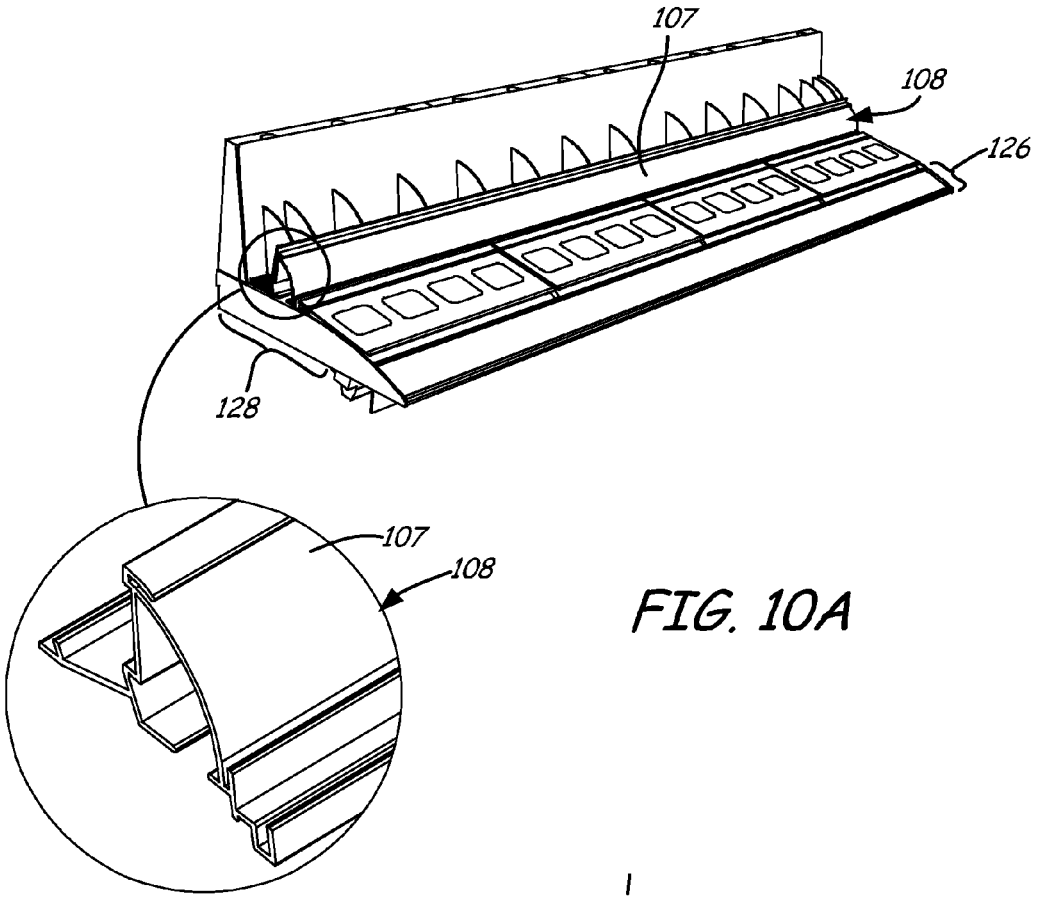
FIG. 10A illustrates an enlarged perspective view of an end of a channel of the tester display fixture illustrated in FIG. 1A.
Figure 10B:
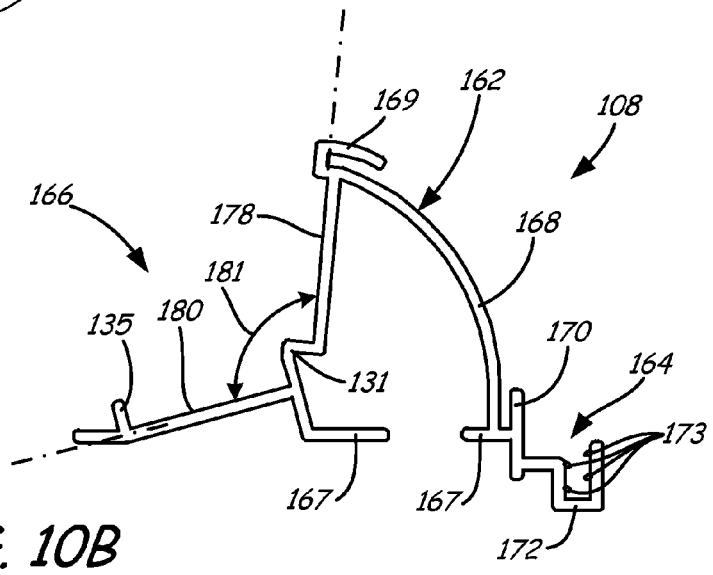
FIG. 10B illustrates a side view of the channel illustrated in FIG. 10A.

As illustrated in FIGS. 8, 9 and 10A, rear support tier 136 of support portion 128 is configured to receive elongated channel 108 and a corresponding graphic lens insert 107 (not shown in FIG. 10A). Elongated channel 108 extends from first side 122 to second side 124 along width 110. As shown in the enlarged side view illustrated in FIG. 10B, elongated channel 108 (without graphic lens insert 107) is formed of a continuous material and includes a graphic retaining portion 162, a front retaining portion 164 and a back retaining portion 166. Elongated channel 108 optionally comprises any of a variety of materials, including molded or extruded polymeric materials such as polyethylene terephthalate (PET) and polyethylene terephthalate glycol (PETG).

Indicia retaining portion 162 of elongated channel 108 includes a curved member 168, an upper slot member 169 and a lower slot member 170. Curved member 168, upper slot member 169 and lower slot member 170 combine to form a housing for receiving a sheet material (not shown) that includes graphics or other indicia and a flexible graphic lens insert 107 (FIGS. 8 and 9). The information sheet includes product information or other indicia while graphic lens insert 107 provides a protective cover for the information sheet.

Front retaining portion 164 of elongated channel 108 is configured to receive and retain at least a portion of each of the tester tray assemblies 104, which will be discussed in detail below. In particular, front retaining portion 164 extends from graphic retaining portion 162 and forward so as to partially extend into the area of the base unit 112 that is occupied by tray receptacle 152. Front retaining portion 164 includes a hook member 172 having a plurality of grippers 173.

Back retaining portion 166 of elongated channel 108 is configured to receive and retain at least a portion of test product divider assembly 106. In particular, back retaining portion 166 is configured to receive and retain a first divider strip 174 (FIGS. 8, 9 and 11) and a second divider strip 176 (FIGS. 8, 9 and 11), which will be discussed in detail below. In particular, back retaining portion 166 extends from graphic retaining portion 162 and backward so as to extend towards the back 120 of base unit 102. Back retaining portion 166 includes a first recessed member 178 and a second recessed member 180. First recessed member 178 and second recessed member 180 define an angle 181 that is greater than 90 degrees. In one exemplary embodiment, the angle defined between first recessed member 178 and second recessed member 180 is about 110 degrees. First recessed member 178 is configured to receive and retain first divider strip 174, while second recessed member 180 is configured to receive and retain second divider strip 176.

The entire elongated channel 108 is coupled to support portion 128 of base unit 112 at the front of rear support tier 136 and is secured to base unit 102 by at least one assembly clip 162 as illustrated in FIG. 11. In one exemplary embodiment, elongated channel 108 is secured to base unit 102 by four assembly clips 162. In some embodiments, each assembly clip 162 includes a main body 163 and a vertically extending member 165 located on each end of main body 163. Each vertically extending member 165 includes notched edges positioned where the vertically extending member 165 intersects with main body 163. Therefore, the notched edges of each assembly clip 162 mate with base members 167 of elongated channel 108 such that when the main body 163 of each assembly clip is coupled to support portion 128 of base unit 102 (via for example a threaded screw), the assembly clip 162 holds elongated channel 108 in place.

As previously discussed, base unit 102 supports the first display configuration of tester products in the form of a plurality of tester tray assemblies 104 positionable in tray receptacle 152 of front support tier 138. Each tester tray assembly 104 includes a tester tray or base 182 (FIGS. 8 and 9), a tester cover 184 (FIGS. 8 and 9) including a hinge portion 179 and at least one removable tester pan of product or tube of product (not illustrated in FIGS. 8 and 9). Exemplary tester pans of product include press-powder and cream-based cosmetic products, such as foundation, eye shadow, bronzer, concealer and blush. Exemplary tubes of product include liquid-based or pencil cosmetic products, such as lip gloss, lipstick, lip liner, mascara, eyeliner and nail polish. Each tester tray 182 is formed of a continuous material, such as vacuum-formed styrene, and includes at least one forward extending tab 183 (FIG. 9) located on the front edge of the tester tray. Each forward extending tab 183 is configured to mate with a corresponding slot 181 (FIG. 8) in front wall 158 of tray receptacle 152 such that tester tray 182 is secured at a front end by shelf 112.

FIGS. 12A-12K illustrate various embodiments of the different types of tester tray assemblies. In one exemplary embodiment, each tester tray 182 includes at least one recessed product receptacle 185 (FIG. 8) for accommodating at least one tester pan of product. In other exemplary embodiments, tester tray 182 includes at least one recessed product receptacle 185 for accommodating at least one tester tube of product.

Figure 12A:
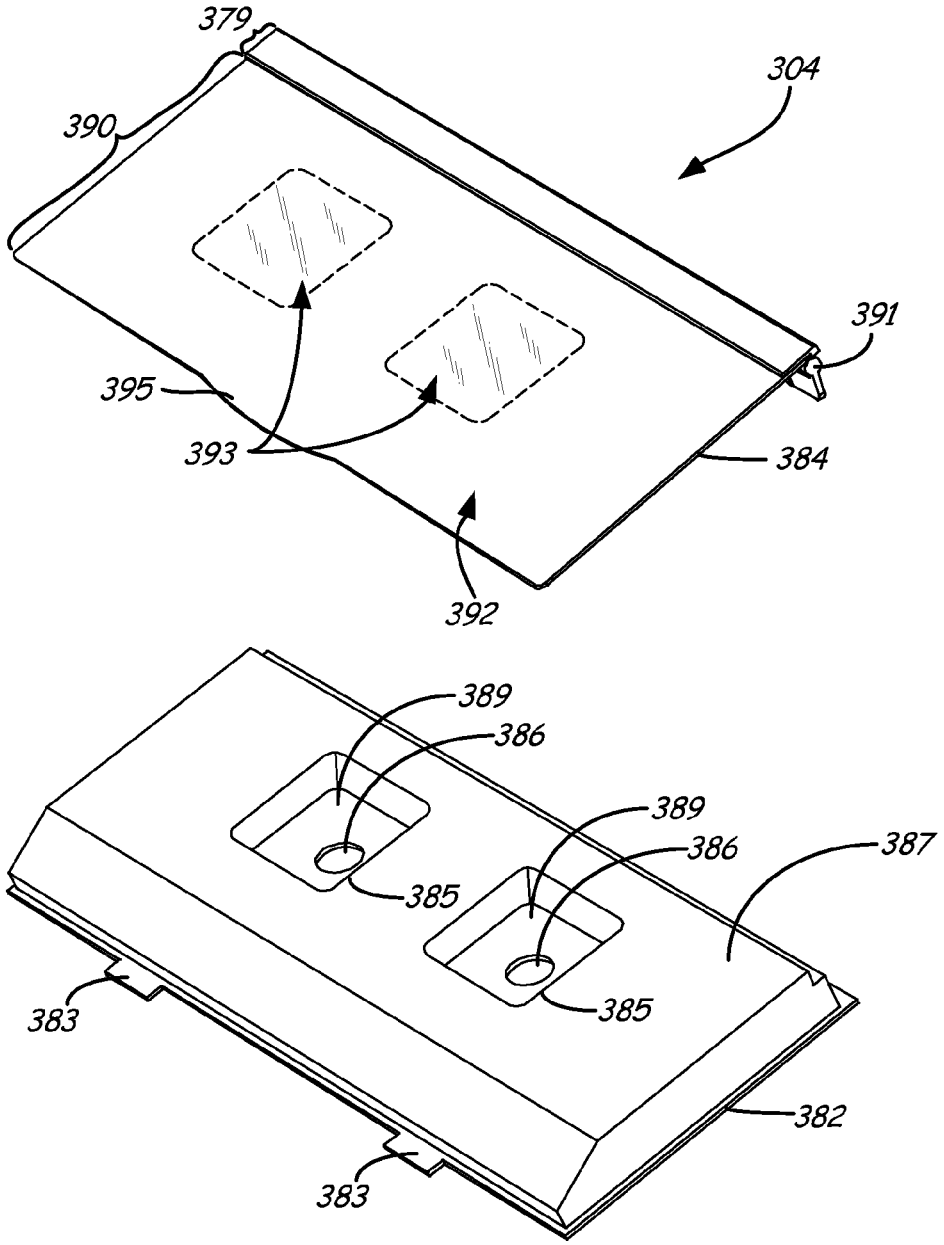
FIGS. 12A-12K illustrate exploded perspective views of different embodiments of tester trays and corresponding tester covers of the tester display fixtures illustrated in FIG. 1A or 1B.

Tester tray assembly 304 illustrated in FIG. 12A includes an exploded view of an exemplary tester tray assembly 304 having a tester tray 382 and a tester cover 384. For purposes of simplicity, tester pans of product are not shown. In FIG. 12A, tester tray 382 includes forward extending tabs 383 and two product receptacles 385 having substantially the same size and having a rectangular shape. Other shapes are possible including circular, triangular and the like. In addition, each product receptacle 385 can be of a different size. Product receptacles 385 include areas or surfaces 389 recessed from top surface 387 of tester tray 382. Each product receptacle 385 includes an aperture 386 that extends from recessed surface 389 to a bottom surface (illustrated as bottom surface 188 in FIG. 9) of tester tray 382. The aperture 386 in each product receptacle 385 allows tester pans of product to be inserted and easily removed from the product receptacle by inserting a human finger through the aperture and pushing the tester pan from the product receptacle.

The size of tester cover 384 corresponds with the size of tester tray 382 such that tester cover 384 covers top surface 387 and includes a hinge portion 379, lid portion 390 and a forward extending tab 395. Hinge portion 379 is coupled to a back edge 391 of tester cover 384. While lid portion 390 is formed of a continuous material, such as a molded or extruded polymeric material like transparent or clear PETG, hinge portion 379 includes multiple components of, for example, polymeric material, to make lid portion 390 rotatable about the back edge of tester tray 382. In particular, hook member 172 of front retaining portion 164 of elongated channel 104 is configured to receive and retain components of hinge portion 379 using grippers 173. Therefore, tester cover 384 is rotatable about front retaining portion 164 of elongated channel 104.

In one embodiment, a bottom surface (illustrated in FIG. 9 as 194) of the transparent or clear material of lid portion 390 is screened with an opaque material to form at least one window. In particular, lid portion 390 includes an opaque area 392 and at least one transparent area or window 393 surrounded by the opaque area 392 (transparent windows 393 are denoted in dashed lines in FIG. 12A). The amount of transparent areas or windows 393 correspond with the amount of product receptacles 385 in tester tray 382. In addition, the size and shape of each transparent area or window corresponds with the size and shape of each product receptacle 385 such that the size and shape of each transparent area or window 393 is substantially the same as the size and shape of each corresponding product receptacle 385. As illustrated in FIG. 12A, lid portion 390 includes two transparent areas 393 having shapes that correspond with the two product receptacles 385 and include substantially the same rectangular shape as the rectangular shape of the two product receptacles. 385.

In operation, a retail store allows a customer to lift lid portion 390 of tester cover 384 using tab 395 or other portion of the lid portion 390 to rotate lid portion 390 about hinge portion 379 and thereby expose the tester pans of product underneath for sampling. In particular, although not specifically illustrated, the surface of tab 395 can include the instructional indicia "lift." During sampling or testing by the customer, top surface 387 of tester tray 382 is susceptible to receiving product spillage or smudging, which detracts from the aesthetic appeal of the display system. When the customer is finished sampling or testing the product, the customer releases lid portion 390 such that lid portion 390 re-covers top surface 387. Tester cover 384 is configured to hide the product spillage because transparent areas 393 allow only the tester product pans to be visible through tester cover 384 and not top surface 387 of tester tray 382.

Figure 12B:
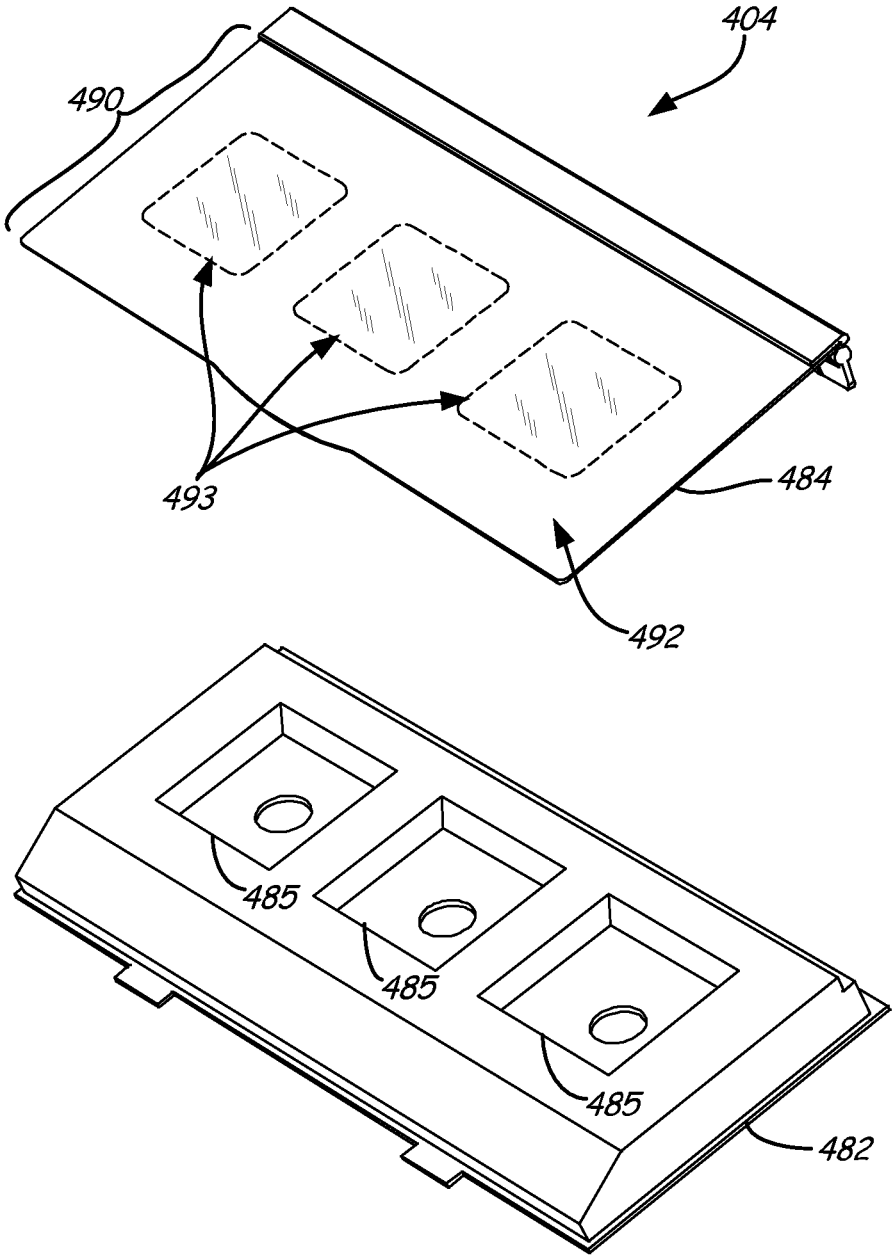

FIG. 12B illustrates an exploded view of an exemplary tester tray assembly 404 having a tester tray 482 and a tester cover 484. For purposes of simplicity, tester products are not shown. In FIG. 12B, tester tray assembly 404 is substantially the same as tester tray assembly 304 except tester tray 482 includes three product receptacles 485 having substantially the same size and having a rectangular shape. Other shapes are possible including circular, triangular and the like. In addition, each product receptacle 485 can be of a different size. Likewise, lid portion 490 of tester cover 484 includes an opaque area 492 and three transparent areas or windows 493 surrounded by the opaque area 492 (transparent windows 393 are denoted in dashed lines in FIG. 12B). Each transparent area or window 493 corresponds with one of the three product receptacles 485 in tester tray 482. In addition, the size and shape of each transparent area or window 493 corresponds with the size and shape of one of the product receptacles 485.

As illustrated in FIGS. 1A, 1B, 2, 6 and 10A and in one embodiment, more than one tray assembly or tester product assembly can be located in tray receptacle or tester product assembly receptacle 152. For example, tester tray assembly 304 and tester tray assembly 404 can both be located in tray receptacle 152. Therefore, after the customer samples product in tester tray assembly 304 as described above, the customer can sample product in tester tray assembly 404. In particular, the customer lifts lid portion 490 of tester cover 484 to rotate lid portion 490 about the hinge portion and thereby expose the tester pans of product underneath for sampling. During sampling, the top surface of tester tray 482 is susceptible to receiving product spillage or smudging, which detracts from the aesthetic appeal of the display system. When the customer is finished sampling, the customer releases lid portion 490 such that lid portion 490 re-covers the top surface of tester tray 482. Tester cover 484 is configured to hide the product spillage because transparent areas 493 allow only the tester product pans to be visible through tester cover 484 and not the top surface of tester tray 482.

Figure 12C:
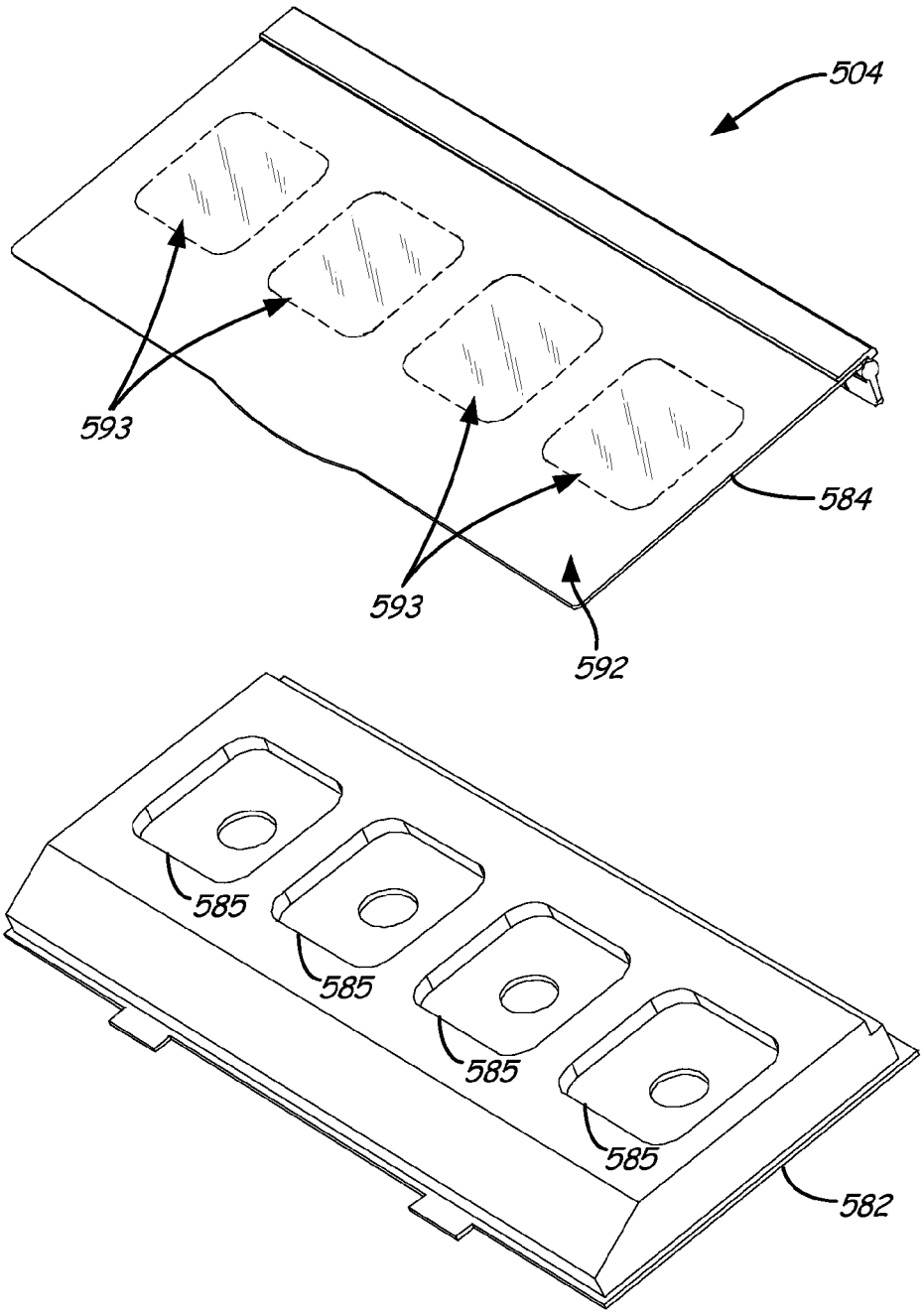

FIG. 12C illustrates an exploded view of an exemplary tester tray assembly 504 having a tester tray 582 and a tester cover 584. For purposes of simplicity, tester products are not shown. In FIG. 12C, tester tray assembly 504 is substantially the same as tester tray assembly 304 except tester tray 582 includes four product receptacles 585 having substantially the same size and having a rectangular shape. Other shapes are possible including circular, triangular and the like. In addition, each product receptacle 585 can be of a different size. Likewise, lid portion 590 of tester cover 584 includes an opaque area 592 and four transparent areas or windows 593 surrounded by the opaque area 592 (transparent windows 593 are denoted in dashed lines in FIG. 12C). Each transparent area or window 593 corresponds with one of the four product receptacles 585 in tester tray 582. In addition, the size and shape of each transparent area or window 593 corresponds with the size and shape of one of the product receptacles 585.

Figure 12D:
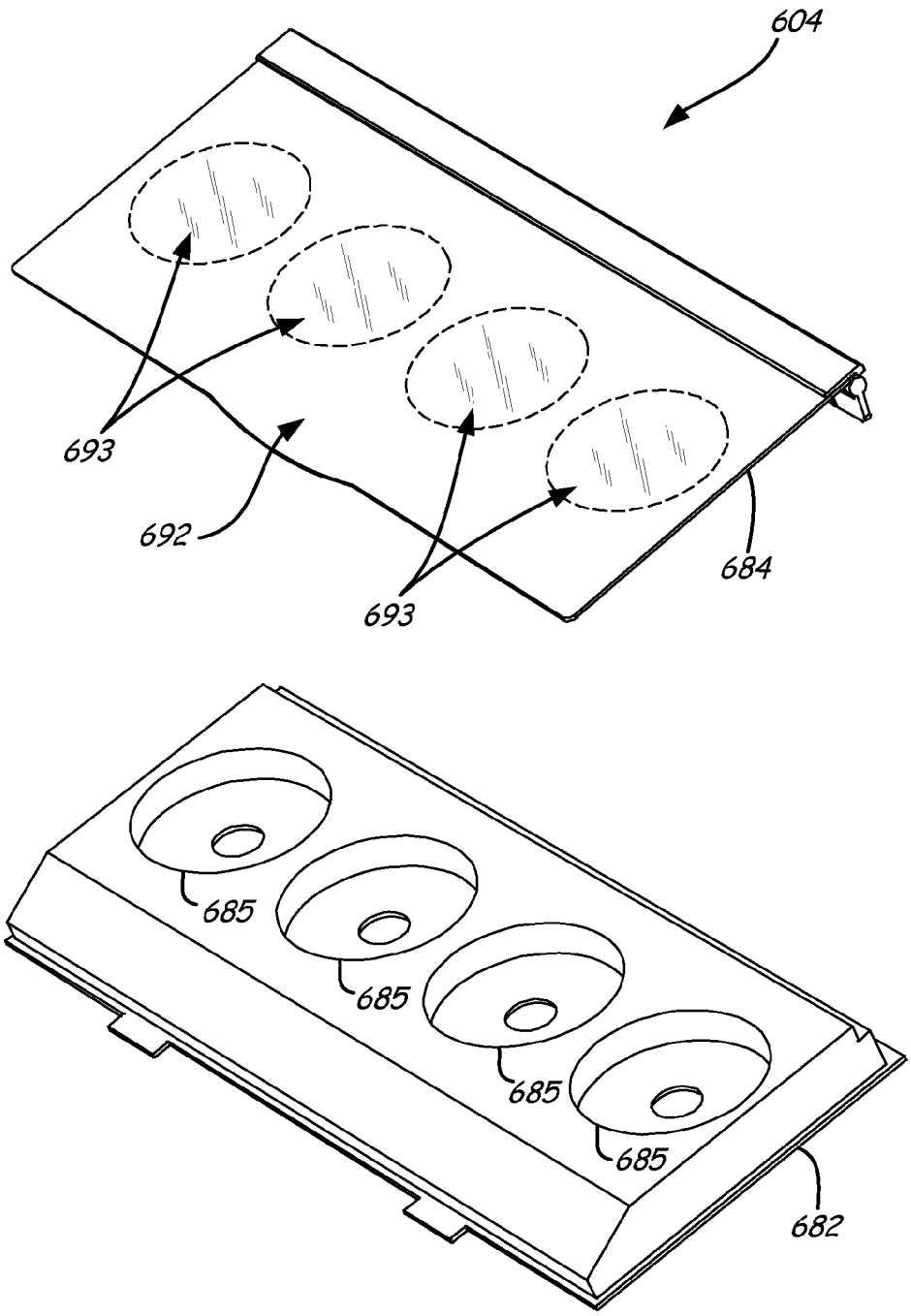

FIG. 12D illustrates an exploded view of an exemplary tester tray assembly 604 having a tester tray 682 and a tester cover 684. For purposes of simplicity, tester products are not shown. In FIG. 12D, tester tray assembly 604 is substantially the same as tester tray assembly 304 except tester tray 682 includes four product receptacles 685 having substantially the same size and having a circular shape. Other shapes are possible including rectangular, triangular and the like. Likewise, lid portion 690 of tester cover 684 includes an opaque area 692 and four transparent areas or windows 693 surrounded by the opaque area 692 (transparent windows 693 are denoted in dashed lines in FIG. 12D). Each transparent area or window 693 corresponds with one of the four product receptacles 685 in tester tray 682. In addition, the size and shape of each transparent area or window 693 corresponds with the size and shape of one of the product receptacles 685.

Figure 12E:
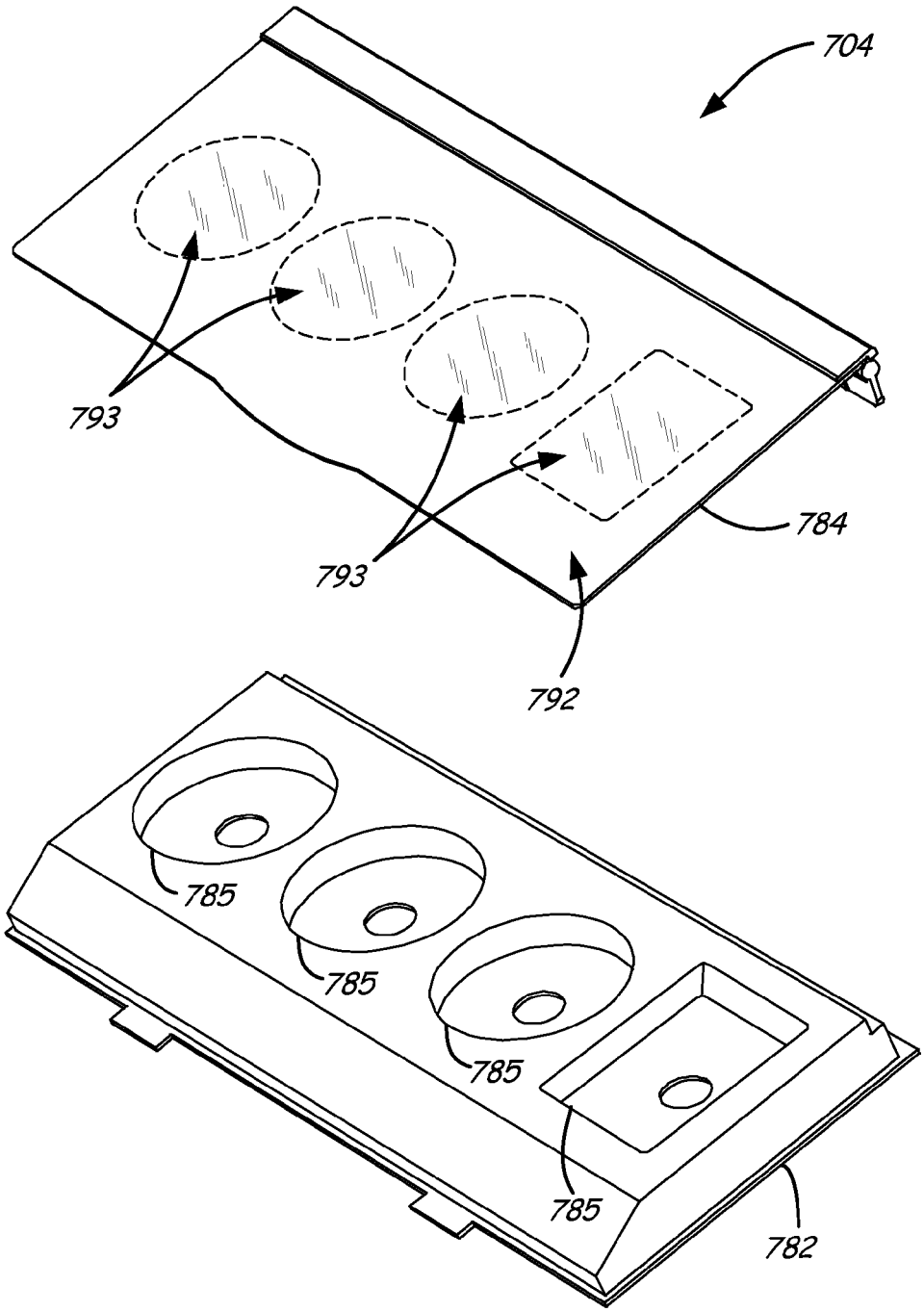

FIG. 12E illustrates an exploded view of an exemplary tester tray assembly 704 having a tester tray 782 and a tester cover 784. For purposes of simplicity, tester products are not shown. In FIG. 12E, tester tray assembly 704 is substantially the same as tester tray assembly 304 except tester tray 782 includes four product receptacles 785 and not all the four product receptacles 785 are of substantially the same shape. Three of the product receptacles 785 include a rectangular shape and one of the product receptacles 785 includes a circular shape. More specifically, the rightmost product receptacle 785 includes the circular shape and the remaining product receptacles 785 include the rectangular shape all of substantially the same size. Likewise, lid portion 790 of tester cover 784 includes an opaque area 792 and four transparent areas or windows 793 surrounded by the opaque area 792 (transparent windows 793 are denoted in dashed lines in FIG. 12D). Each transparent area or window 793 corresponds with one of the four product receptacles 785 in tester tray 782. For example, the rightmost window 793 includes a rectangular window that corresponds with the rectangular rightmost product receptacle 785, while the remaining windows 793 include circular windows that correspond with the circular remaining product receptacles 785. In addition, the size of each rectangular transparent area or window 793 corresponds with the size of each rectangular product receptacle 785. The size of the circular transparent area or window 793 corresponds with the size of the circular product receptacle 785.

Figure 12F:
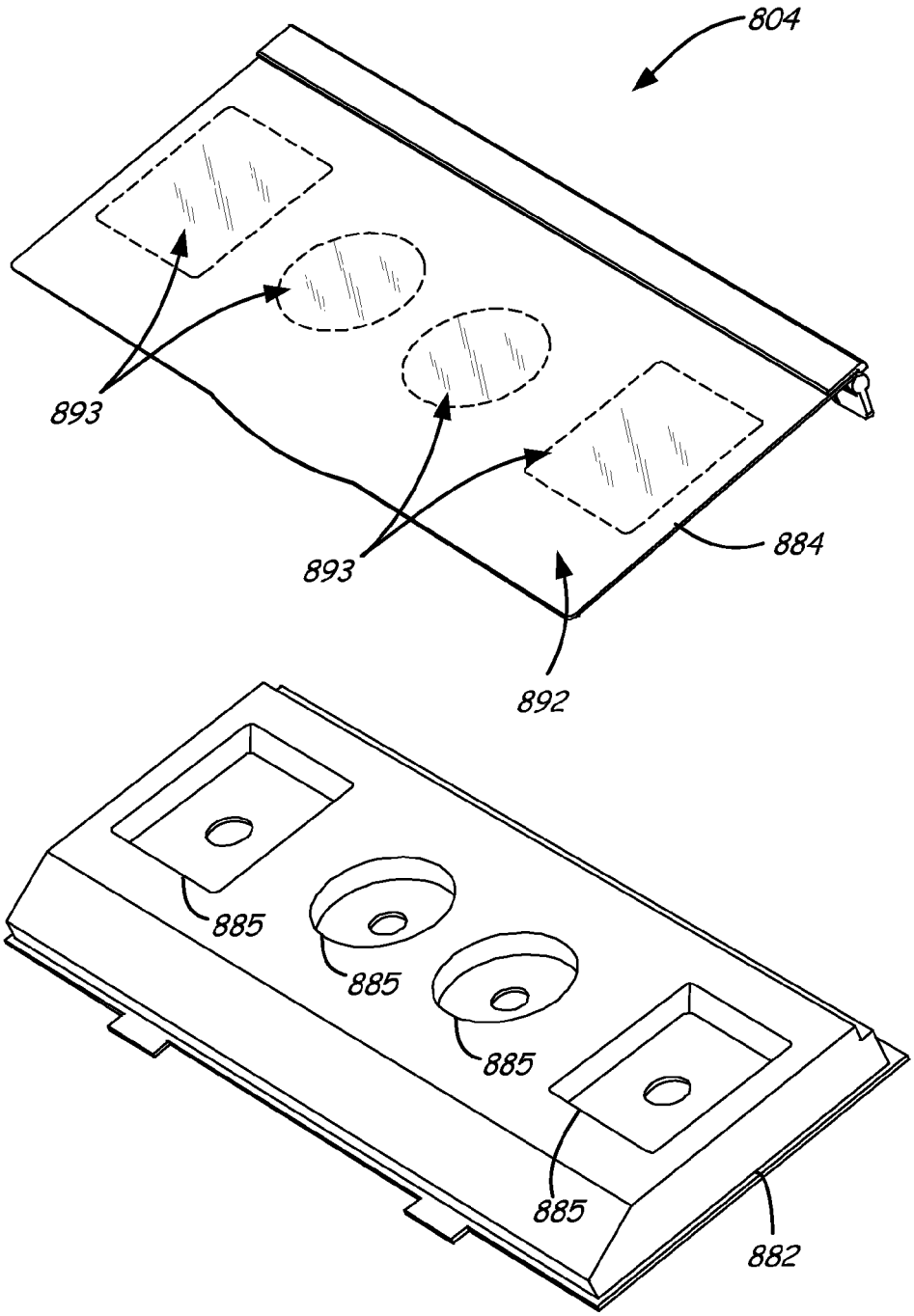

FIG. 12F illustrates an exploded view of an exemplary tester tray assembly 804 having a tester tray 882 and a tester cover 884. For purposes of simplicity, tester products are not shown. In FIG. 12F, tester tray assembly 804 is substantially the same as tester tray assembly 304 except tester tray 882 includes four product receptacles 885 that are not all substantially the same shape. Two of the product receptacles 885 include a rectangular shape and two of the product receptacles 885 include a circular shape. More specifically, the rightmost product receptacle 885 and the leftmost product receptacle include substantially the same rectangular shape and size and the centrally located remaining two product receptacles 885 include substantially the same rectangular shape size. Likewise, lid portion 890 of tester cover 884 includes an opaque area 892 and four transparent areas or windows 893 surrounded by the opaque area 892 (transparent windows 893 are denoted in dashed lines in FIG. 12E). Each transparent area or window 893 corresponds with one of the four product receptacles 885 in tester tray 882. For example, the rightmost window 893 and the leftmost window 893 include a rectangular window that correspond with the rectangular rightmost and the rectangular leftmost product receptacles 885, while the remaining centrally located windows 893 include circular windows that correspond with the centrally located remaining product receptacles 885 that are circular. In addition, the size of each transparent area or window 893 corresponds with the size of its corresponding product receptacle 885.

Figure 12G:
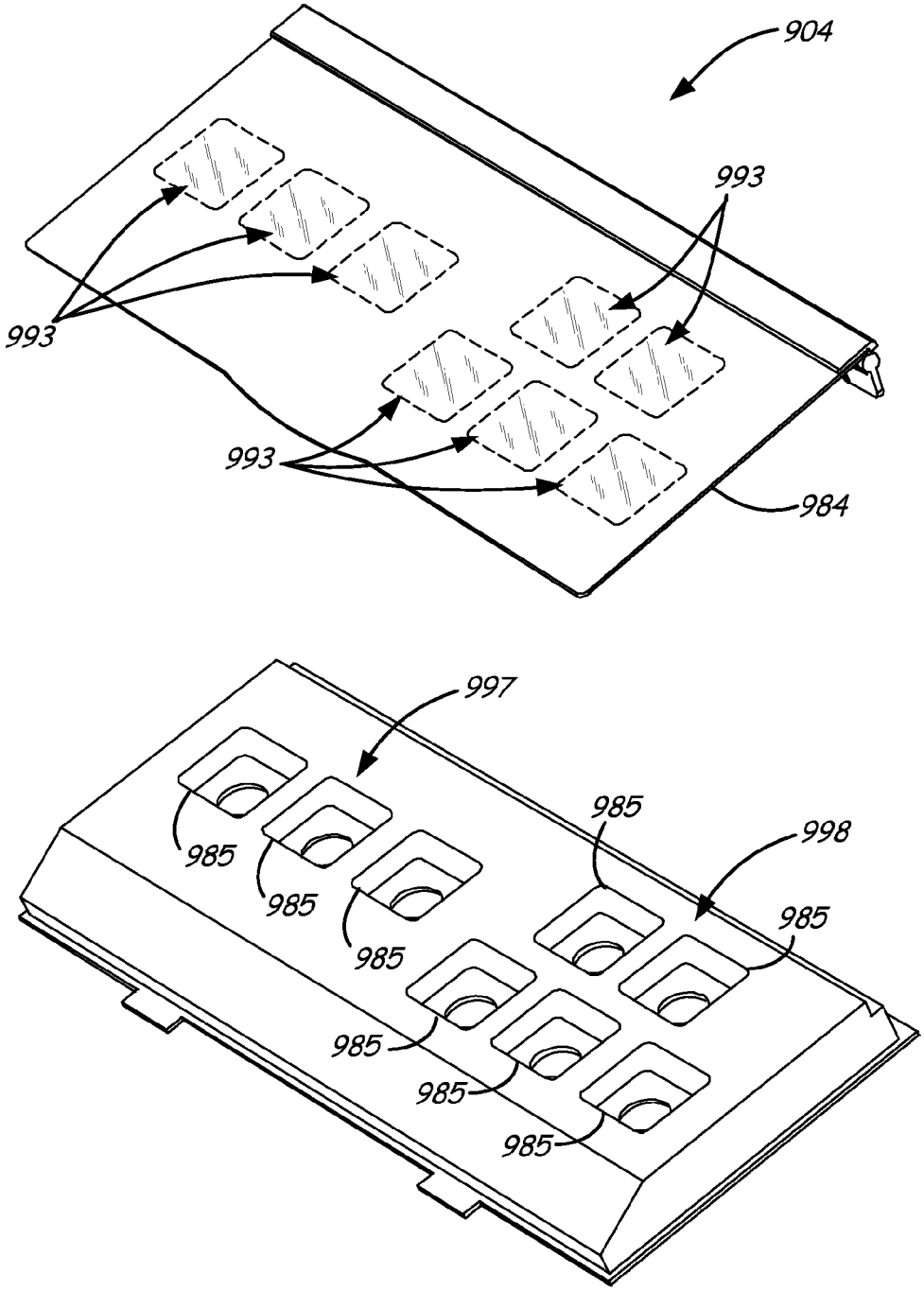

FIG. 12G illustrates an exploded view of an exemplary tester tray assembly 904 having a tester tray 982 and a tester cover 984. For purposes of simplicity, tester products are not shown. In FIG. 12G, tester tray assembly 904 is substantially the same as tester tray assembly 304 except tester tray 982 includes eight product receptacles 985 of substantially the same size that have a rectangular shape. Other shapes are possible including circular, triangular and the like. Likewise, lid portion 990 of tester cover 984 includes an opaque area 992 and eight transparent areas or windows 993 surrounded by the opaque area 992 (transparent windows 993 are denoted in dashed lines in FIG. 12G). Each transparent area or window 993 corresponds with one of the eight product receptacles 985 in tester tray 982. In addition, the size and shape of each transparent area or window 993 corresponds with the size and shape of its corresponding product receptacle 985. While the eight product receptacles 985 and corresponding windows 993 are arranged on tester tray 982 as illustrated (a first grouping 997 of three product receptacles 985 on the right and a second grouping 998 of five product receptacles 985 on the left), the eight product receptacles 985 can be arranged in any desirable way.

Figure 12H:
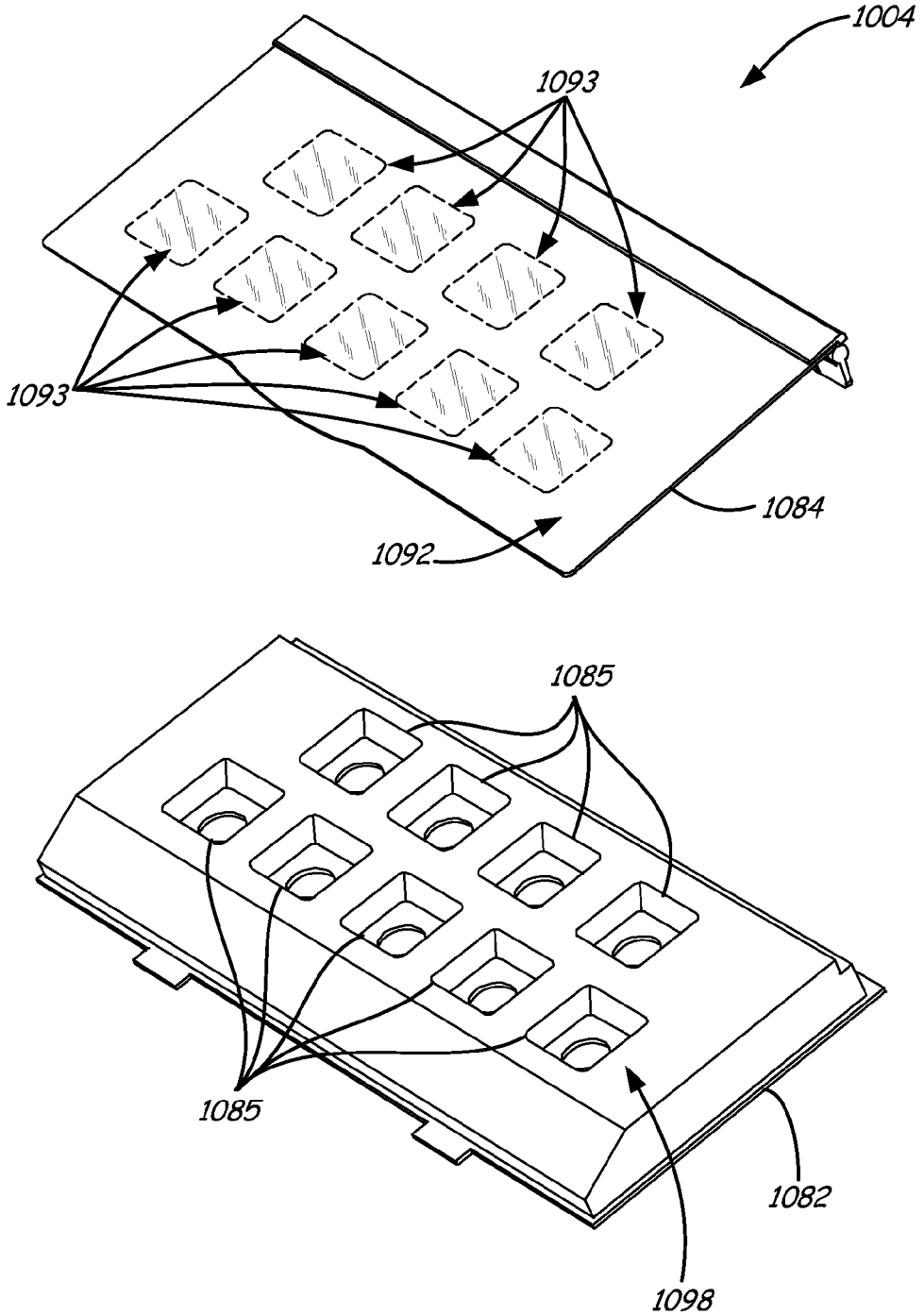

FIG. 12H illustrates an exploded view of an exemplary tester tray assembly 1004 having a tester tray 1082 and a tester cover 1084. For purposes of simplicity, tester products are not shown. In FIG. 12H, tester tray assembly 1004 is substantially the same as tester tray assembly 304 except tester tray 1082 includes nine product receptacles 1085 of substantially the same size that have a rectangular shape. Other shapes are possible including rectangular, triangular and the like. Likewise, lid portion 1090 of tester cover 1084 includes an opaque area 1092 and nine transparent areas or windows 1093 surrounded by the opaque area 1092 (transparent windows 1093 are denoted in dashed lines in FIG. 12H). Each transparent area or window 1093 corresponds with one of the nine product receptacles 1085 in tester tray 1082. In addition, the size and shape of each transparent area or window 1093 corresponds with the size and shape of its corresponding product receptacle 1085. While the nine product receptacles 1085 and corresponding windows 1093 are arranged on tester tray 1082 as illustrated (a first line 1097 of three product receptacles 1085 located above a second line 1098 of five product receptacles 1085), the nine product receptacles 1085 can be arranged in any desirable way.

Figure 12I:
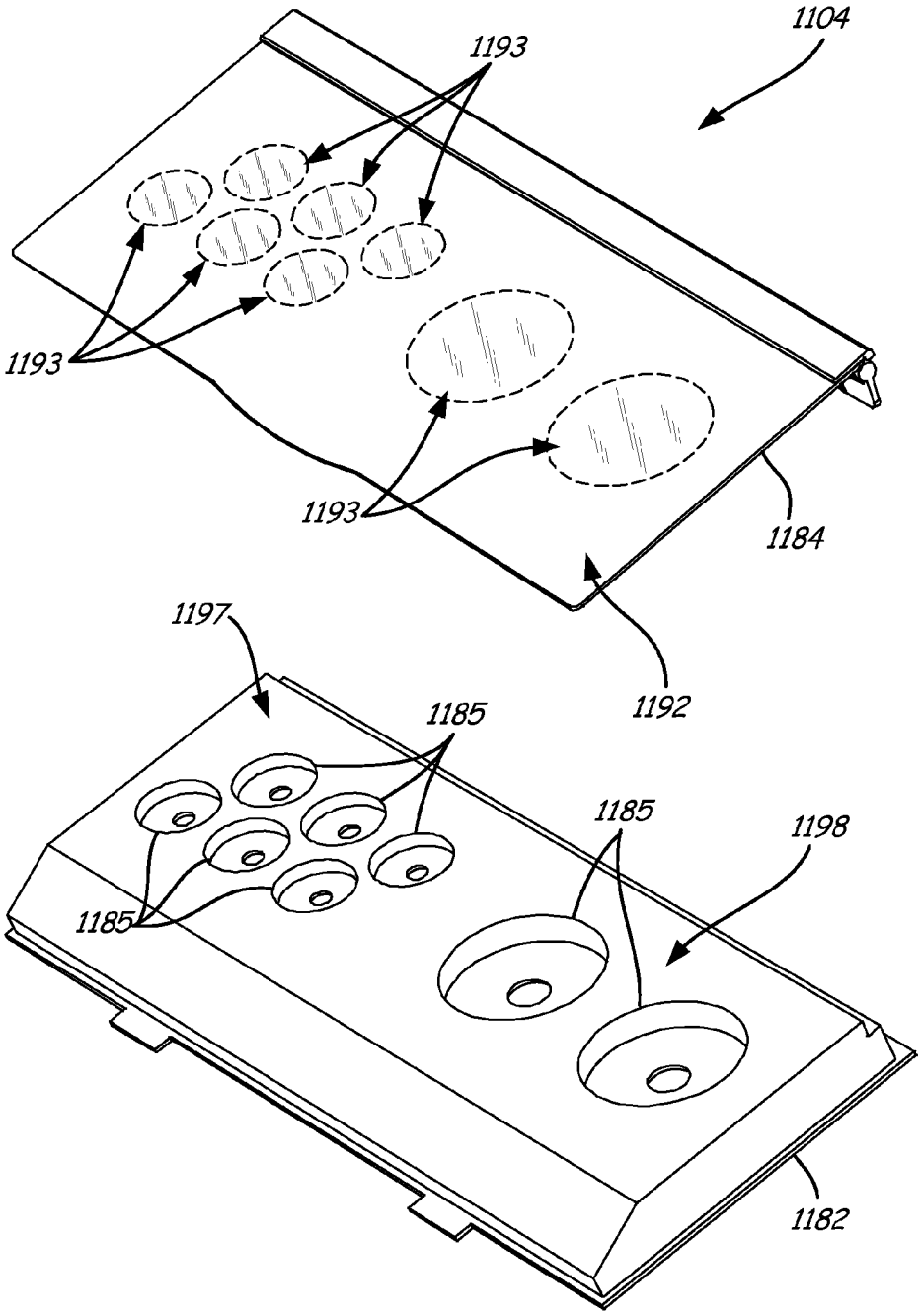

FIG. 12I illustrates an exploded view of an exemplary tester tray assembly 1104 having a tester tray 1182 and a tester cover 1184. For purposes of simplicity, tester products are not shown. In FIG. 12I, tester tray assembly 1104 is substantially the same as tester tray assembly 304 except tester tray 1182 includes eight product receptacles 1185 that have a circular shape. Other shapes are possible including rectangular, triangular and the like. The eight product receptacles include a first grouping 1197 of six product receptacles 1185 and a second grouping 1198 of two product receptacles 1185. Each product receptacle 1185 in the first grouping 1197 is of substantially the same size and each product receptacle 1185 in the second grouping 1198 is of substantially the same size. Likewise, lid portion 1190 of tester cover 1184 includes an opaque area 1192 and eight transparent areas or windows 1193 surrounded by the opaque area 1192 (transparent windows 1193 are denoted in dashed lines in FIG. 12I). Each transparent area or window 1193 corresponds with one of the nine product receptacles 1185 in tester tray 1182. In addition, the size and shape of each transparent area or window 1193 corresponds with the size and shape of its corresponding product receptacle 1185. While the eight product receptacles 1185 and corresponding windows 1193 are arranged on tester tray 1182 as illustrated (i.e., first grouping 1197 on the left and second grouping 1198 on the right), the eight product receptacles 1085 can be arranged in any desirable way.

Figure 12J:
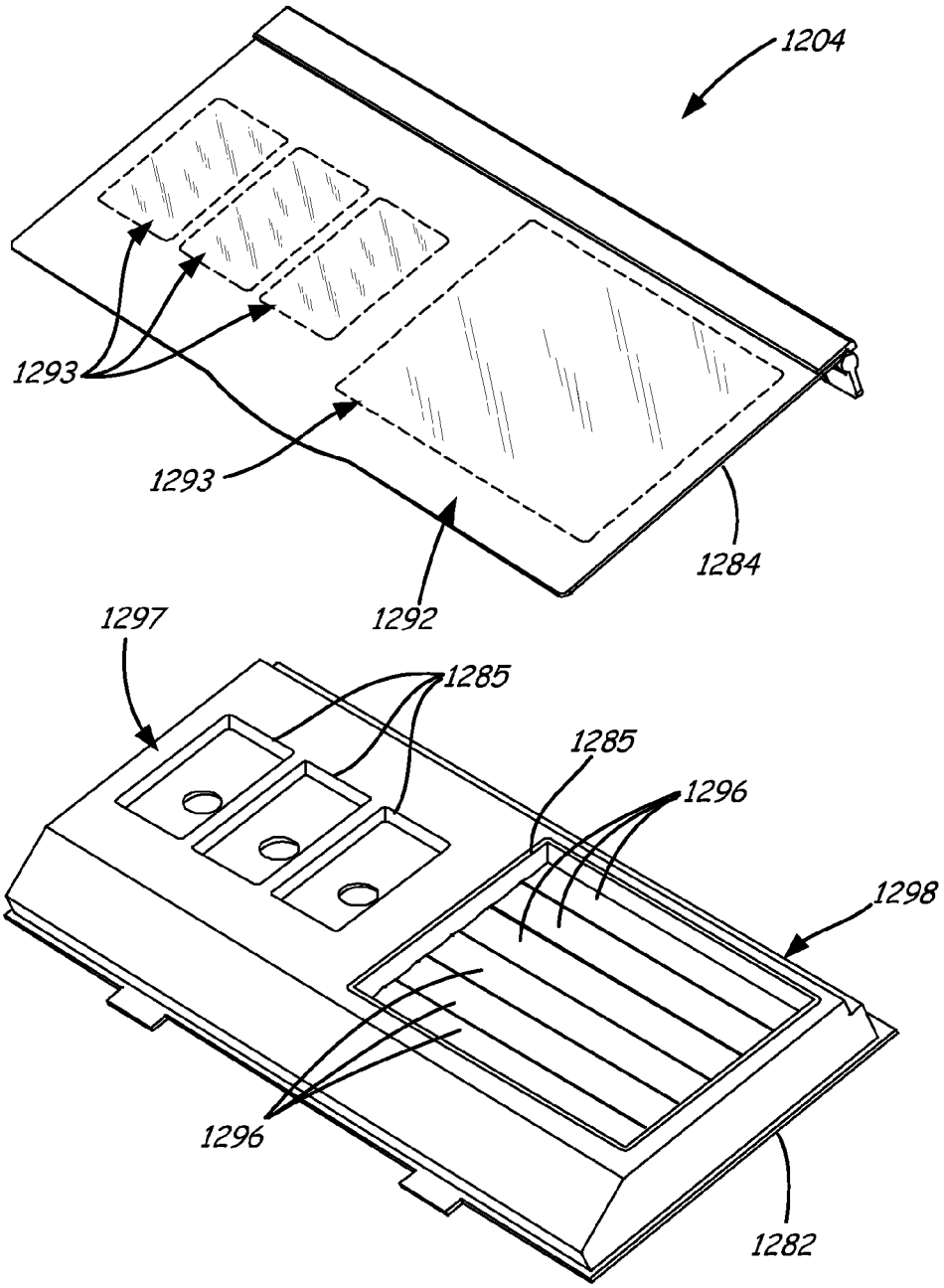

FIG. 12J illustrates an exploded view of an exemplary tester tray assembly 1204 having a tester tray 1282 and a tester cover 1284. For purposes of simplicity, tester products are not shown. In FIG. 12J, tester tray assembly 1204 is substantially the same as tester tray assembly 304 except tester tray 1282 includes four product receptacles 1285 that have a rectangular shape. Other shapes are possible including circular, triangular and the like. The four product receptacles include a first grouping 1297 of three product receptacles 1285 and a second grouping 1298 of a single product receptacle 1285. Each product receptacle 1285 in the first grouping 1297 is of substantially the same size, while the single product receptacle 1285 in the second grouping 1298 is of a size that is different than the product receptacles in the first grouping. Unlike tester tray assembly 304, the single product receptacle 1285 in the second grouping does not have an aperture in the recessed area or surface 1289. Rather, recessed surface 1289 includes at least one concave portion 1296. Each concave portion 1296 is configured to receive a tester tube of product rather than a tester pan of product.

Likewise, lid portion 1290 of tester cover 1284 includes an opaque area 1292 and four transparent areas or windows 1293 surrounded by the opaque area 1292 (transparent windows 1293 are denoted in dashed lines in FIG. 12J). Each transparent area or window 1293 corresponds with one of the four product receptacles 1285 in tester tray 1282. In addition, the size and shape of each transparent area or window 1293 corresponds with the size and shape of its corresponding product receptacle 1285. While the four product receptacles 1285 and corresponding windows 1293 are arranged on tester tray 1282 as illustrated (i.e., first grouping 1297 on the left and second grouping 1298 on the right), the four product receptacles 1285 can be arranged in any desirable way.

Figure 12K:
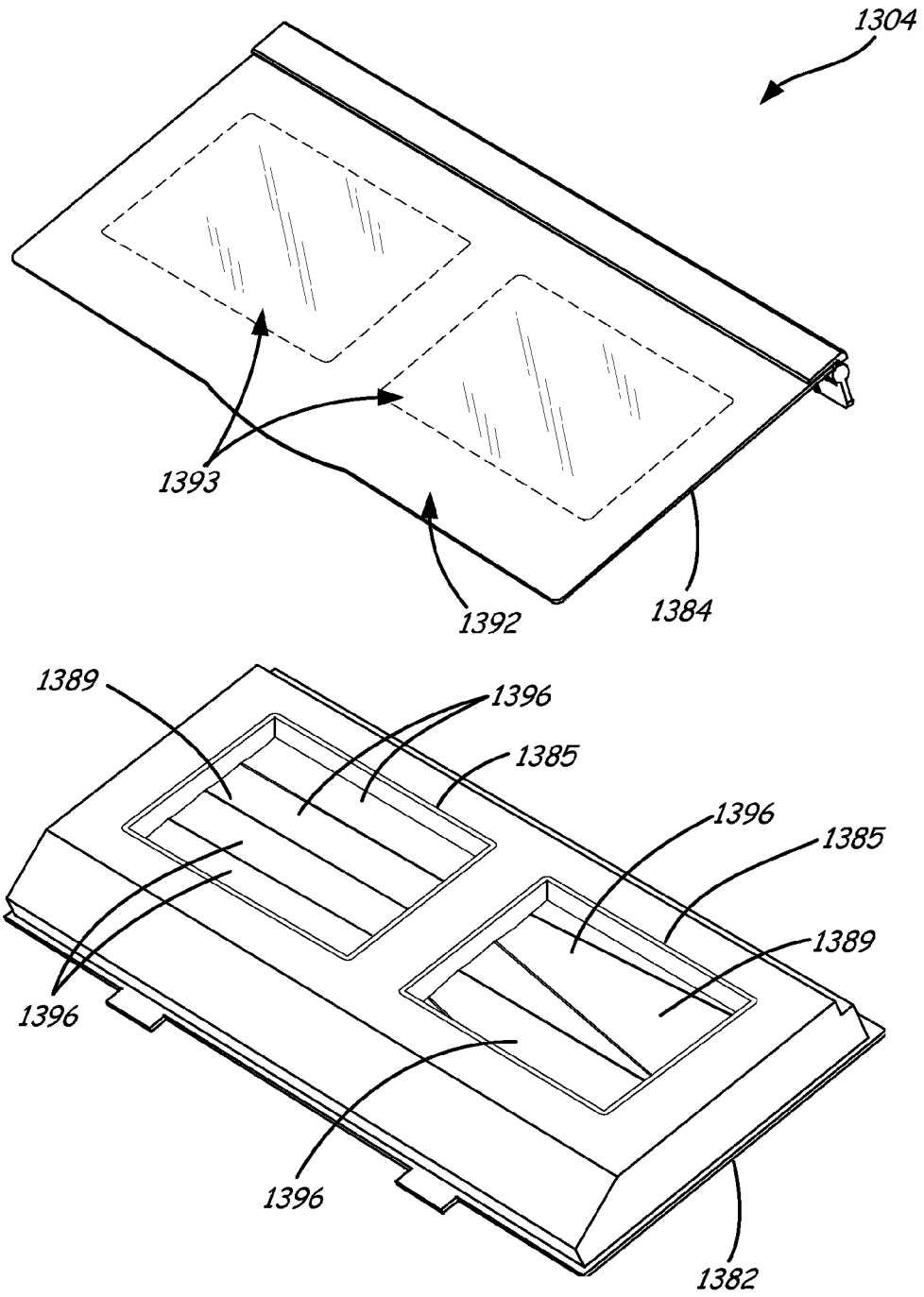

FIG. 12K illustrates an exploded view of an exemplary tester tray assembly 1304 having a tester tray 1382 and a tester cover 1384. For purposes of simplicity, tester products are not shown. In FIG. 12K, tester tray assembly 1304 is substantially the same as tester tray assembly 304 except tester tray 1382 includes product receptacles 1385 that do not have an aperture in the recessed area or surface 1389. Rather, each recessed surface 1389 of each product receptacle 1385 includes at least one concave portion 1396. Each concave portion 1396 is configured to receive a tester tube of product rather than a tester pan of product.

Likewise, lid portion 1390 of tester cover 1384 includes an opaque area 1392 and two transparent areas or windows 1393 surrounded by the opaque area 1392 (transparent windows 1393 are denoted in dashed lines in FIG. 12K). Each transparent area or window 1393 corresponds with one of the two product receptacles 1385 in tester tray 1382. In addition, the size and shape of each transparent area or window 1393 corresponds with the size and shape of its corresponding product receptacle 1385.

With reference back to FIGS. 1-9 and 11, base unit 102 supports the second mode of displaying tester products in the form of a test product divider assembly 106. Test product divider assembly 106 includes a back riser 112 located at the back 120 of base unit 102, a back riser lens 111, first divider strip 174 (previously discussed), second divider strip (previously discussed) and a plurality of dividers 115. Back riser 112 extends from first side 122 to second side 124 of base unit 102 along width 110. Back riser 112 is wedge-shaped and includes a top having a smaller depth than the bottom. Located on the front 113 of back riser 112 includes a back riser lens 111 (FIGS. 8 and 9). Back riser lens is configured to receive a sheet material of printed graphics and indicia.

As previously discussed first and second divider strips 174 and 176 (both extending the width of display fixture 110 and therefore the width of elongated channel 108) are located in back retaining portion 166 of elongated channel 106 and are made of a polymeric material, such as an injected molded polymeric material including styrene, for example. In particular, first divider strip 174 is located in first recessed member 178 of elongated channel 106 and second divider strip 176 is located in second recessed member 180 of elongated channel 106. Therefore, first divider strip 174 is oriented in a plane that is greater than 90 degrees from the plane the second divider strip 176 is oriented in. First divider strip 174 includes a first plurality of slots 117 and second divider strip 176 includes a second plurality of slots. Each of the first slots 117 of first divider strip 174 and each of the second slots 127 of second divider strip 176 are configured to receive a divider 115. However, as illustrated in FIGS. 1A, 1B, 2 and 6, dividers 115 are not inserted into every slot 117 of first divider strip 174 nor are dividers 115 inserted into every slot 127 of second divider strip 176. Rather, dividers 115 are inserted into first select slots of first divider strip 174 and select second slots of second divider strip 176.

Figure 13:
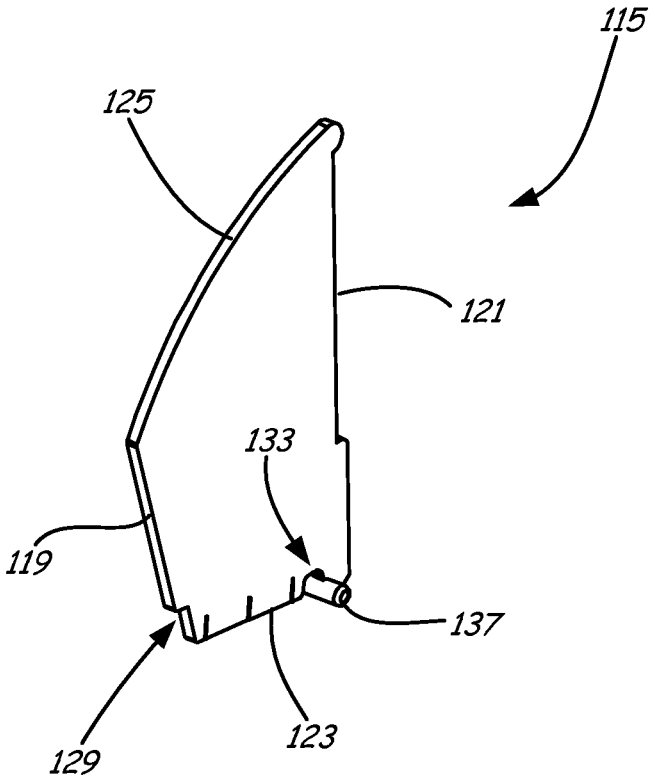
FIG. 13 illustrates a perspective view of a divider of the tester display fixtures illustrated in FIGS. 1A and 1B.
Figure 14:
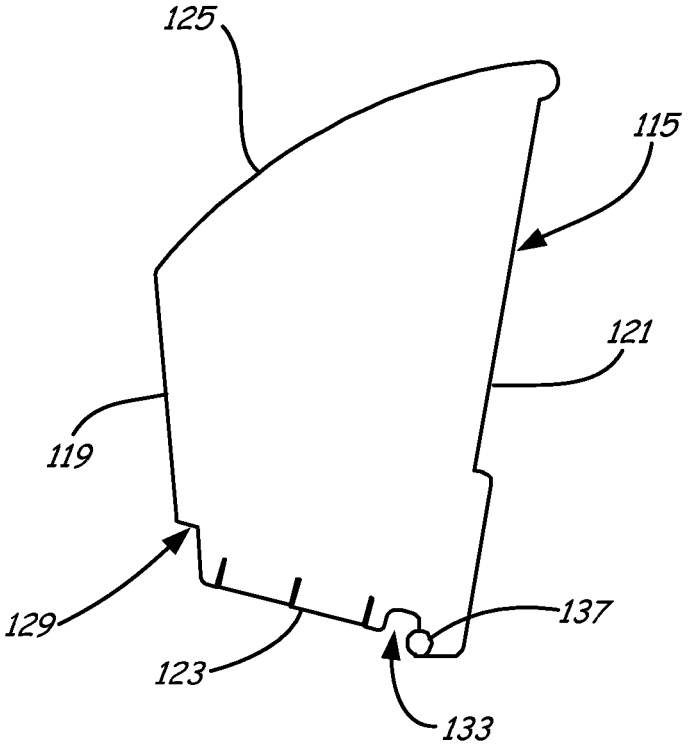
FIG. 14 illustrates a side view of the divider illustrated in FIG. 13.

FIG. 13 illustrates a perspective view of an exemplary divider 115 and FIG. 14 illustrates a side view of the exemplary divider. Divider 115 includes a front edge 119, a back edge 121, a bottom edge 123 and a top edge 124. Front edge 119 is configured to be inserted into a select slot 117 of first divider strip 174 and includes a bottom notch 129. Bottom notch 129 is configured to mate with a corner notch 131 of back retaining portion 166 of elongated channel 108. Bottom edge 123 is configured to be inserted into a select slot 127 of second divider strip 176 and includes a back notch 133. Back notch 133 is configured to mate with a protrusion 135 of back retaining portion 166 of elongated channel 108. In addition, divider 115 includes an axle portion 137 that protrudes from both the right side and left side surfaces of divider 115 and is configured to help insert divider 115 into first divider strip 174 and second divider strip 176. In particular and as better illustrated in FIG. 11, divider 115 is assembled by inserting the back of bottom edge 123 or axle portion 137 between the back of elongated channel 108 and back riser 112 and then rotating the divider 115 forward so as to first engage bottom edge 123 with second divider strip 176 and then front edge 119 with first divider strip 174.

For example and as illustrated in FIG. 2, a first divider 115-1 is inserted into a first select slot (not illustrated) of first divider strip 174 and a corresponding first select slot 127-1 of second divider strip 176. A second divider 115-2 is inserted into a second select slot (not illustrated) of first divider strip 174 and a corresponding second select slot 127-2 of second divider strip 176. The first divider 115-1 is spaced a plurality of slots away from the second divider 115-2 such that the first divider 115-1, the second divider 115-2, the back riser 112 and the elongated channel 108 form a first tester product holder 139. In this manner, dividers 115 are inserted into corresponding select slots across the entire width of each of first divider strip 174 and second divider strip 176 so as to form a plurality of tester product holders for holding tester product. As illustrated, tester products are various different sizes. Therefore, dividers are spaced apart from each by different distances (i.e., different numbers of slots) to accommodate the different sizes of tester products.

In addition, the sheet material of graphics and/or indicia that is received by back riser lens 111 includes graphical representations of the tester products that are located in the plurality of tester product holders defined by dividers 115, elongated channel 108 and back riser 112. More specifically, graphical representations are printed on the sheet material at substantially the same spaced distance from each other such that the printed graphic of the tester product is located immediately behind the actual tester product and between the dividers 115 that define the holding area for that particular tester product.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method of allowing sampling of tester product comprising:

instructing a user to lift a cover on a first tester product assembly to expose at least one tester product, the first tester product assembly comprising:

a base located in a tester product assembly receptacle of a display shelf, the base including a front edge, a back edge, and at least one product receptacle for accommodating the at least one tester product;

the cover being rotatable about the back edge of the base, the cover having an opaque area and at least one transparent window surrounded by the opaque area, the at least one transparent window having a size and shape that is substantially the same as a size and a shape of the at least one product receptacle of the base, the cover further comprising a hinge, wherein the hinge includes an elongated leg portion extending downwardly from the hinge and the cover and an extrusion member coupled to the shelf adjacent to the back edge of the base, the extrusion member further comprises a front hook extending from a bottom portion of the extrusion member, and the front hook defines a channel;

inserting the elongated leg portion of the hinge of the cover within the channel of the front hook of the extrusion member so that the cover rotates to cover or uncover the at least one product receptacle;

allowing the user to sample the at least one tester product in the first tester product assembly; and allowing the user to release the cover so as to re-cover the at least one tester product in the first tester product assembly.

2. The method of claim 1, wherein the base of the first tester product assembly further comprises a top surface and a bottom surface, the at least one product receptacle of the first tester product assembly being recessed from the top surface of the base of the first tester product assembly.

3. The method of claim 1, further comprising:

instructing the user to lift a cover on a second product tester assembly to expose at least one tester product, the second tester product assembly comprising:

a base located in the tester product assembly receptacle of the display shelf and including at least one product receptacle for accommodating the at least one tester product of the second product tester assembly;

the cover of the second product tester assembly including a hinge component and being rotatable about a back edge of the base of the second product tester assembly, the cover of the second product tester assembly having an opaque area and at least one transparent window surrounded by the opaque area, the at least one transparent window of the second product tester assembly having a size and shape that is substantially the same as a size and a shape of the at least one product receptacle of the second product tester assembly;

allowing the user to sample the at least one tester product of the second tester product assembly; and allowing the user to release the cover of the second tester product assembly so as to re-cover the at least one tester product of the second tester product assembly.

4. The method of claim 3, wherein the hinge of the cover of the second tester product assembly is retained by the elongated channel that is coupled to the shelf.

5. The method of claim 1, wherein allowing the user to release the cover so as to re-cover the at least one tester product in the first tester product assembly comprises hiding spillage located on the upper surface of the base when the base is covered by the cover.

6. The method of claim 3, wherein allowing the user to release the cover of the second tester product assembly so as to recover the at least one tester product of the second tester product assembly comprises hiding spillage located on the upper surface of the base of the second product tester assembly when the base of the second product tester assembly is covered by the cover of the second product tester assembly.

7. A method for allowing products to be sampled comprising:

instructing a user to lift a lid portion of a top on a product tray assembly to uncover at least one tester product, the product tray assembly comprising: a base located on a display shelf, the base including a back, a front, an upper surface and at least one recessed compartment that is recessed from the upper surface and holds the at least one tester product;

the top having the lid portion and a hinge connected to the lid portion, wherein the hinge portion includes an elongated leg portion that allows the lid portion to be rotatable about the back of the base so that the lid portion rotates to cover and uncover the at least one recessed compartment in the base and wherein the lid portion includes an opaque area and at least one transparent area surrounded by the opaque area that corresponds with the at least one recessed compartment, the elongated leg portion extending downwardly from the hinge and the lid portion; and an extrusion member located adjacent to the back of the base, the extrusion member further comprises a front hook extending from a bottom portion of the extrusion member, and the front hook defines a channel;

inserting the elongated leg portion of the hinge of the cover within the channel of the front hook of the extrusion member allowing the cover to rotate with respect to the base;

allowing the user to sample the at least one tester product in the at least one recessed compartment; and allowing the user to release the lid portion so that the lid portion covers the at least one recessed compartment in the base.

8. The method of claim 7, wherein the at least one transparent area has a size and a shape that corresponds with a size and a shape of the at least one recessed compartment that holds the at least one tester product such that when the lid portion covers the base, product that has spilled onto the upper surface of the base from the tester product located in the at least one recessed compartment is hidden by the opaque area of the lid portion while the tester product remains visible through the transparent area of the lid portion.

9. The method of claim 7, wherein the opaque area has a size and a shape that corresponds with a size and a shape of the upper surface of the base such that when the lid portion covers the base, product that has spilled onto the upper surface of the base from the tester product located in the at least one recessed compartment is hidden by the opaque area of the lid portion while the tester product remains visible through the transparent area of the lid portion.

10. The method of claim 7, wherein the channel comprises a plurality of grippers for retaining the elongated leg portion of the hinge of the cover.

11. The method of claim 7, wherein allowing the user to release the lid portion so that the lid portion covers the at least one recessed compartment in the base comprises hiding spillage located on the upper surface of the base when the base is covered by the lid portion.

12. A method for allowing products to be sampled comprising:

providing a tray located on a display shelf, the tray including an upper surface and at least one product receptacle recessed from the upper surface, the tray holding at least one tester product;

providing a cover so as to cover and uncover the tray, the cover including a hinge that is rotatable about a back edge of the tray and a lid component, the lid component having an opaque area and at least one transparent window surrounded by the opaque area that corresponds with the at least one product receptacle, wherein the hinge includes an elongated leg portion extending downwardly from the hinge and the cover and an extrusion member coupled to the shelf adjacent to the back edge of the tray, the extrusion member further comprises a front hook extending from a bottom portion of the extrusion member, and the front hook defines a channel;

inserting the elongated leg portion of the hinge of the cover within the channel of the front hook of the extrusion member so that the cover rotates to cover or uncover the at least one product receptacle;

placing indicia on the opaque area of the lid component that instructs a user to lift the cover to sample tester product held in the at least one product receptacle; and allowing access to the tester product in the at least one product receptacle when the cover is rotated to uncover the tray.

13. The method of claim 12, wherein the elongated channel of the extrusion member includes a plurality of grippers for retaining the elongated leg portion of the hinge.

14. The method of claim 12, wherein the at least one product receptacle comprises a plurality of product receptacles having substantially the same size and shape as one another.

15. The method of claim 14, wherein the at least one transparent window comprises a plurality of transparent windows that each correspond with one of the plurality of product receptacles.

16. The method of claim 12, further comprising hiding spillage located on the upper surface of the tray when the tray is covered by the lid component.

17. The method of claim 12, wherein the indicia on the opaque area of the lid component is located on a tab of the lid component.

18. The method of claim 12, wherein the at least one transparent window comprises a size and shape that is substantially the same as a size and a shape of the at least one product receptacle of the tray.

* * * * *